US010499750B2

(12) United States Patent
Mason et al.

(10) Patent No.: US 10,499,750 B2
(45) Date of Patent: Dec. 10, 2019

(54) JUVENILE WALKER

(71) Applicant: Dorel Juvenile Group, Inc., Foxboro, MA (US)

(72) Inventors: Grant M. Mason, Wrentham, MA (US); Jorge Tomas, Wrentham, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 0 days.

(21) Appl. No.: 16/141,295

(22) Filed: Sep. 25, 2018

(65) Prior Publication Data

US 2019/0090658 A1 Mar. 28, 2019

Related U.S. Application Data

(60) Provisional application No. 62/563,867, filed on Sep. 27, 2017.

(51) Int. Cl.
*A47D 13/04* (2006.01)
*A47D 1/00* (2006.01)

(52) U.S. Cl.
CPC ..... *A47D 13/043* (2013.01); *A47D 1/002* (2013.01)

(58) Field of Classification Search
CPC ..... A47D 13/043; A47D 1/002
See application file for complete search history.

(56) References Cited

U.S. PATENT DOCUMENTS

| | | | | |
|---|---|---|---|---|
| 4,799,700 | A | 1/1989 | Knoedler et al. | |
| 5,407,246 | A * | 4/1995 | Meeker | A47D 13/102 248/372.1 |
| 5,451,093 | A | 9/1995 | Petrie et al. | |
| 5,688,211 | A * | 11/1997 | Myers | A47D 13/107 297/5 |
| 5,728,030 | A * | 3/1998 | Hsieh | A47D 13/043 472/15 |
| 5,934,747 | A | 8/1999 | Garland | |
| 6,000,750 | A | 12/1999 | Rossman et al. | |
| 6,012,731 | A | 1/2000 | Liu | |
| 6,299,247 | B1 * | 10/2001 | Meeker | A47D 13/102 248/372.1 |
| 6,386,563 | B1 | 5/2002 | Chen et al. | |
| 6,425,842 | B1 | 7/2002 | Stern et al. | |
| 6,682,139 | B2 | 1/2004 | Bellows et al. | |
| 6,715,826 | B2 | 4/2004 | Bellows et al. | |
| 7,025,364 | B1 | 4/2006 | Clarke | |
| 7,244,165 | B2 | 7/2007 | Gubitosi et al. | |
| 7,287,768 | B2 * | 10/2007 | Myers | A47D 3/00 280/649 |
| 7,510,238 | B2 | 3/2009 | McClintock et al. | |
| 7,523,984 | B2 | 4/2009 | Steininger | |
| 9,185,994 | B2 | 11/2015 | Bums et al. | |
| 2002/0164917 | A1 | 11/2002 | Keegan et al. | |
| 2008/0113581 | A1 | 5/2008 | Jazenski et al. | |
| 2013/0341891 | A1 | 12/2013 | Brewin et al. | |
| 2015/0102574 | A1 | 4/2015 | Sundberg et al. | |
| 2016/0088954 | A1 | 3/2016 | Burns et al. | |

* cited by examiner

*Primary Examiner* — Bryan A Evans
(74) *Attorney, Agent, or Firm* — Brnes & Thornburg LLP

(57) ABSTRACT

A juvenile holder such as a juvenile walker includes a seat and a rolling base. The seat supports a young child for movement with the rolling base.

27 Claims, 9 Drawing Sheets

JUVENILE WALKER

PRIORITY CLAIM

This application claims priority under 35 U.S.C. § 119(e) to U.S. Provisional Application No. 62/563,867, filed Sep. 27, 2017, which is expressly incorporated by reference herein.

BACKGROUND

The present disclosure relates to juvenile holders, and particularly to juvenile walkers that have movable seats. More particularly, the present disclosure relates to a juvenile walker having a rotatable seat.

SUMMARY

A juvenile holder in accordance with the present disclosure includes a seat for child. In illustrative embodiments, juvenile walker in accordance with the present disclosure includes a seat and a rolling base adapted to roll along ground underlying the rolling base. The seat is adapted to support a young child for movement with the rolling base.

In illustrative embodiments, the juvenile walker comprises a rolling platform-elevation base and a child carrier including a seat-support platform and a rotatable seat. The seat is mounted for 360° rotation in a central opening formed in the seat-support platform. The seat-support platform is mounted in an elevated position on the rolling platform-elevation base to allow a caregiver or child to rotate the seat about a vertical seat-rotation axis to change the rotated orientation of the seat relative to the elevated seat-support platform.

In illustrative embodiments, the juvenile walker also includes a seat-rotation blocker that is coupled to the seat-support platform and can be used by a caregiver to block rotation of the seat about the vertical seat-rotation axis relative to the elevated seat-support platform when the seat occupies a forward-facing position on the elevated seat-support platform. The seat-rotation blocker includes a bolt that can be moved relative to the elevated seat-support platform (1) to engage the rotatable seat so that rotation of the seat about the vertical seat-rotation axis relative to the seat-support platform is blocked and (2) to disengage the rotatable seat so that the seat is allowed to rotate about the vertical seat-rotation axis relative to the seat-support platform.

In illustrative embodiments, the seat-rotation blocker further includes a bolt mover located in a hollow region formed in the seat-support platform and coupled to the bolt and a bolt-mover actuator that can be accessed and operated by a caregiver to cause the bolt mover to push the bolt to a seat-engaging position to block seat rotation or the retract the bolt to a seat-disengaging position to allow seat rotation. The bolt-mover actuator includes a motion-generator lever that extends outwardly through a lever-access window that is formed in the seat-support platform so that the motion-generator lever can be gripped by the caregiver and moved relative to the elevated seat-support platform. The bolt-mover actuator also includes a motion-transfer system that functions to convert motion generated by the motion-generator lever into movement of the bolt relative to the elevated seat-support platform between the seat-engaging position and the seat-disengaging position.

In illustrative embodiments, the motion-generator lever extends through a lever-access window formed in a rear portion of an outer rim of the seat-support platform so that it can be finger-gripped by a caregiver. The caregiver can slide the motion-generator lever to the left relative to the elevated seat-support platform to place the seat-rotation blocker in a SEAT-LOCKING MODE and, alternatively, to the right to place the seat-rotation blocker in SEAT-ROTATING MODE.

In illustrative embodiments, the motion-transfer system includes a cam coupled to the motion-generator lever and a cam follower coupled to the bolt mover. To assume the SEAT-LOCKING MODE, movement of the motion-generator lever to the left causes the cam to move the cam follower toward the seat so that the bolt pusher is also moved toward the seat to push the bolt to the seat-engaging position when the seat occupies a forward-facing position on the seat-support platform and thereby block rotation of the seat about the vertical seat-rotation axis relative to the elevated seat-support platform. To assume the SEAT-ROTATING MODE, movement of the motion-generator lever back to the right causes the cam to move the cam follower away from the seat so that the bolt retractor is also moved away from the seat to retract the bolt to the seat-disengaging position and thereby free the seat to be rotated about the vertical seat-rotation axis relative to the seat-support platform.

Additional features of the present disclosure will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
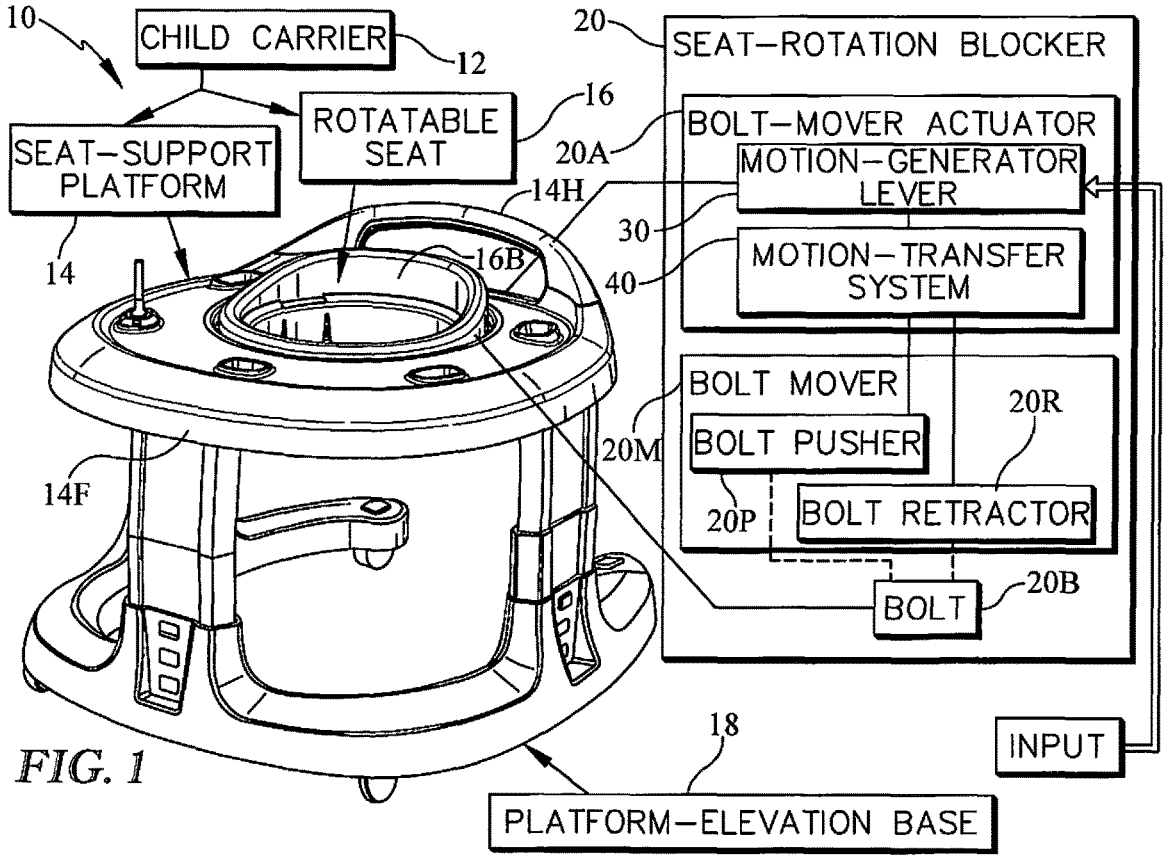
FIG. 1 is a perspective view of a juvenile walker in accordance with the present disclosure showing an illustrative child carrier including an elevated seat-support platform and a rotatable seat and a diagrammatic seat-rotation blocker including a bolt that can be moved relative to the elevated seat-support platform by a caregiver using a bolt mover and a bolt-mover actuator (1) to engage the seat to block rotation of the seat about a vertical seat-rotation axis relative to the seat-support platform as suggested in FIGS. 2, 10, 11 and 13 and (2) to disengage the seat to allow rotation of the seat about the vertical seat-rotation axis relative to the seat-support platform as suggested in FIGS. 3, 14, 15 and 17.

A juvenile walker 10 is configured to provide mobile seating for a toddler (not shown) as shown in FIG. 1. Walker 10 includes a child carrier 12 comprising an elevated seat-support platform 14 and a rotatable seat 16 mounted for rotation on seat-support platform 14 about a vertical seat-rotation axis 16A as suggested in FIGS. 2 and 3. Walker 10 also includes a rolling platform-elevation base 18 coupled to the underside of seat-support platform 14 as suggested in FIG. 1.

Figure 2A:
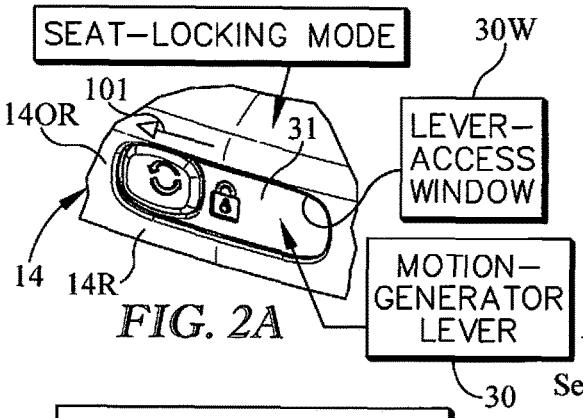
FIG. 2A is an enlarged view of the circled region taken from FIG. 2 showing that a slidable motion-generator lever that is included in the seat-rotation blocker and visible in a lever-access window formed in an outer rim of the elevated seat-support platform has been moved by a caregiver to the left relative to the outer rim to establish a SEAT-LOCKING MODE of the seat-rotation blocker.
Figure 3A:
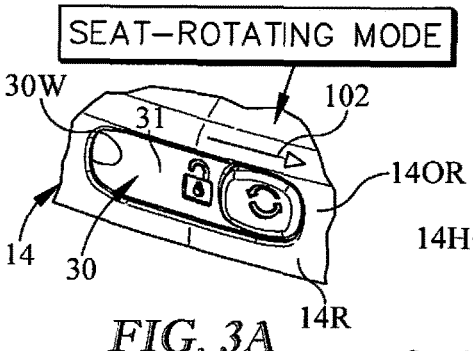
FIG. 3A is an enlarged view of the circled region taken from FIG. 3 showing that the slidable motion-generator lever has been moved by the caregiver to the right relative to the outer rim of the elevated seat-support platform to establish the SEAT-ROTATING MODE of the seat-rotation blocker.
Figure 3:
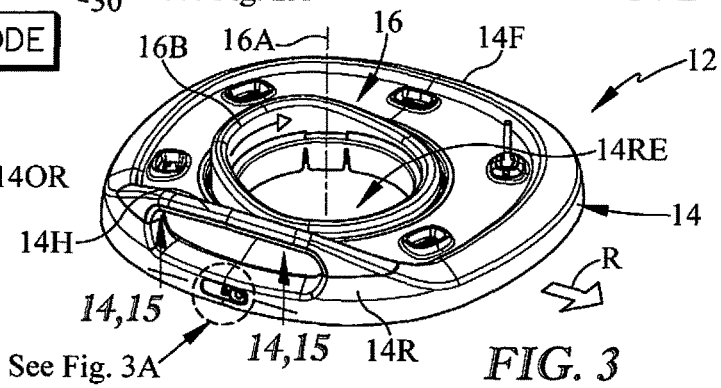
FIG. 3 is a view similar to FIG. 2 showing that the rotatable seat has been rotated one-quarter turn in a clockwise direction by a caregiver or child to face to the right after the slidable motion-generator lever was moved to the right by the caregiver to establish a SEAT-ROTATING MODE of the seat-rotation blocker.
Figure 4:
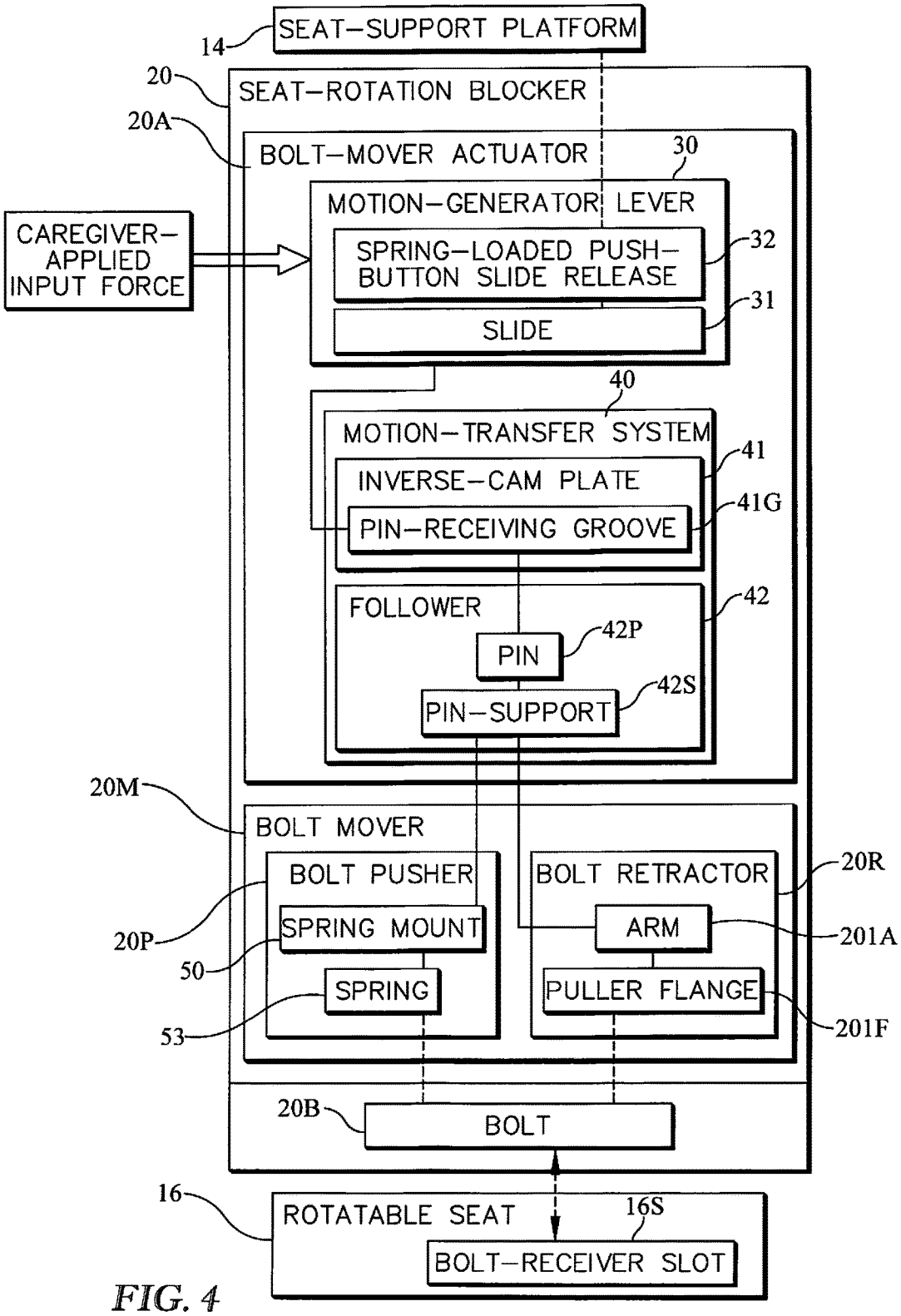
FIG. 4 is a diagrammatic view of a portion of the juvenile walker of FIG. 1 showing the elevated seat-support platform and the rotatable seat of the child carrier and components included in the bolt-mover actuator and bolt mover of the seat-rotation blocker and suggesting that a movable bolt included in the seat-rotation blocker can be moved by a bolt pusher included in the bolt mover into a bolt-receiver slot formed in the rotatable seat to establish the SEAT-LOCKING MODE and block rotation of the rotatable seat relative to the seat-support platform and also suggesting that a bolt retractor included in the bolt mover can be used to withdraw the movable bolt from the bolt-receiver slot formed in the rotatable seat to free the seat for rotation about vertical seat-rotation axis.
Figure 5:
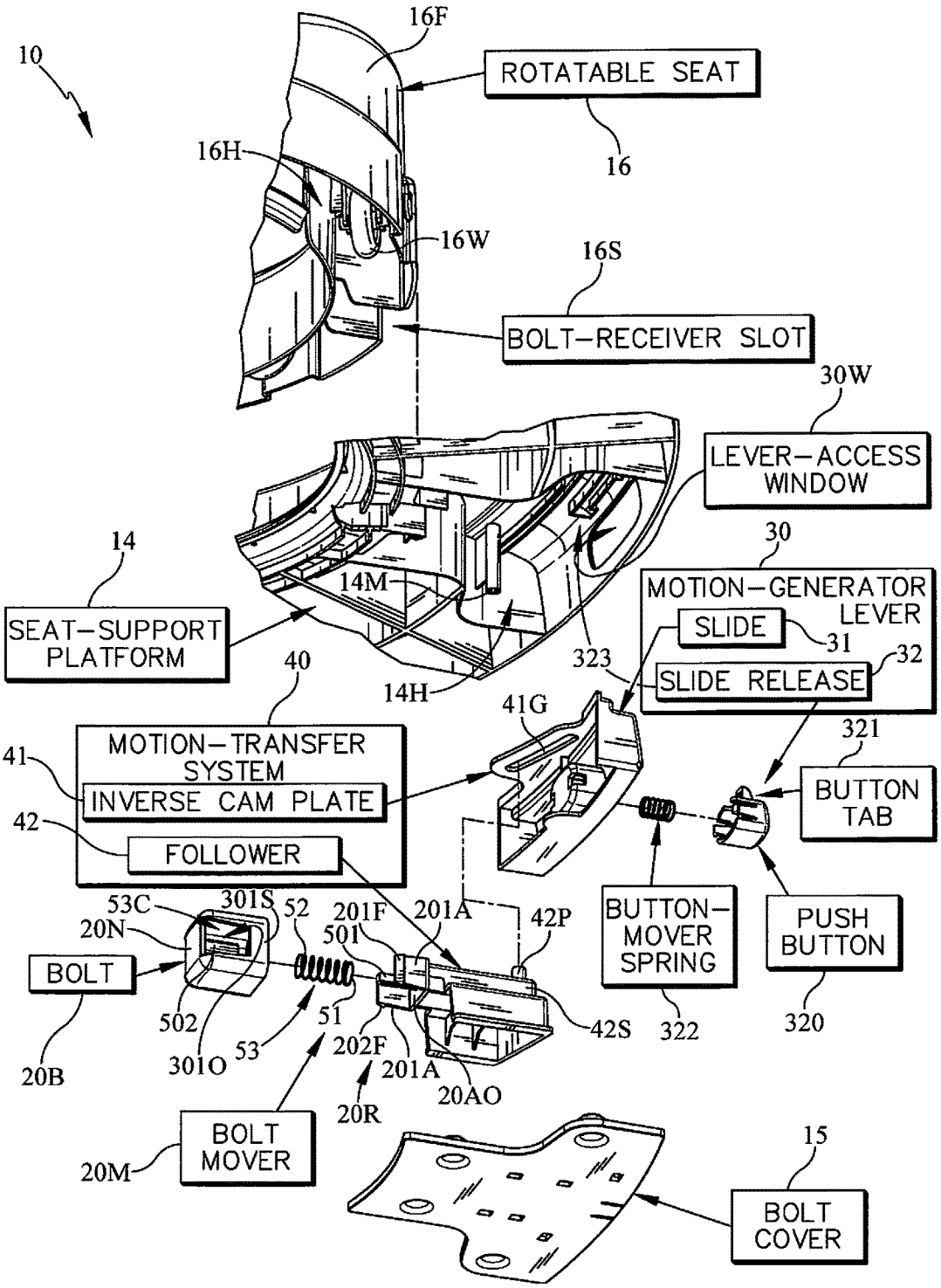
FIG. 5 is an exploded perspective assembly view of the illustrative components included in the seat-rotation blocker shown diagrammatically in FIG. 4 along with partial sections of the rotatable seat and the seat-support platform and showing that a bolt-receiver slot is formed in an outer portion of the rotatable seat and that the outer rim of the seat-support platform is formed to include a lever-access window sized and located to expose the slidable motion-generator lever so that it can be gripped by a caregiver and moved relative to the elevated seat-support platform between the positions shown in FIGS. 2A and 3A.

A seat-rotation blocker 20 is also included in juvenile walker 10 as suggested diagrammatically in FIGS. 1 and 4 and illustratively in FIG. 5. Seat-rotation blocker 20 includes a movable bolt 20B and is mounted on seat-support platform 14 to move therewith as suggested in FIG. 1. Seat-rotation blocker 20 can be operated by a caregiver to assume a SEAT-LOCKING MODE in which movable bolt 20B is moved relative to elevated seat-support platform 14 to engage rotatable seat 16 so that rotation of rotatable seat 16 about vertical seat-rotation axis 16A relative to elevated seat-support platform 14 is blocked as suggested in FIGS. 2, 2A, and 10-13. Seat-rotation blocker 20 can also be operated by a caregiver to assume a SEAT-ROTATING MODE in which movable bolt 20B is retracted to disengage rotatable seat 16 as suggested in FIGS. 3, 3A, and 14-17 to free rotatable seat 16 to be rotated about vertical seat-rotation axis 16A from a forward-facing position shown in FIG. 2 to, for example, a right-facing position shown in FIG. 3, or another suitable rotated position. In illustrative embodiments, rotatable seat 16 can be locked in a stationary position on elevated seat-support platform 14 using seat-rotation blocker 20 only when rotatable seat 16 occupies a predetermined position such as a forward-facing position as shown, for example, in FIG. 1.

Figure 2:
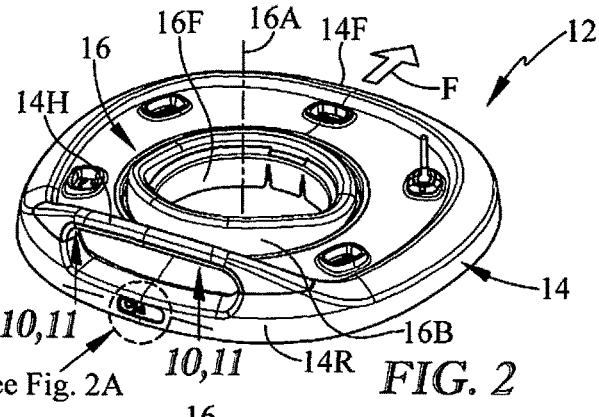
FIG. 2 is a rear perspective view of the child carrier of FIG. 1 showing that the rotatable seat is locked in a forward-facing position.
Figure 6:
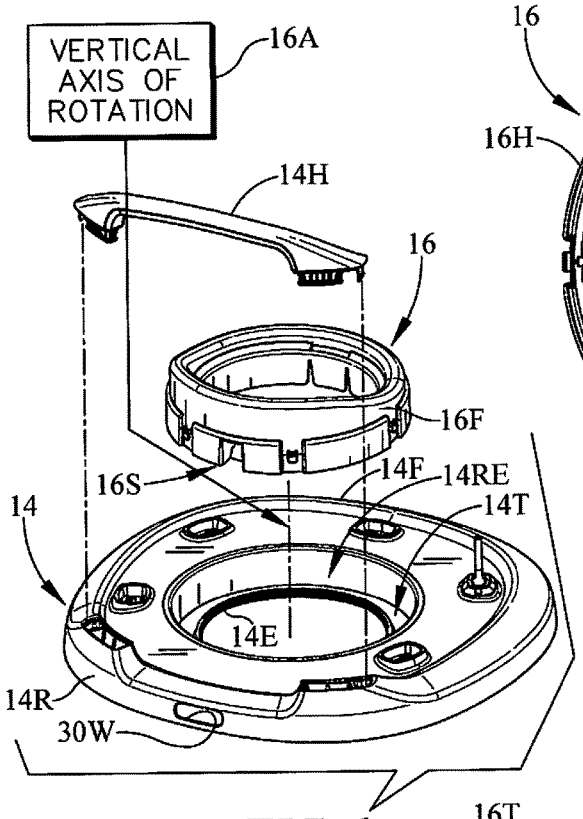
FIG. 6 is an exploded perspective assembly view showing the rotatable seat before it is lowered into a ring-shaped seat receiver formed in the elevated seat-support platform.
Figure 7:
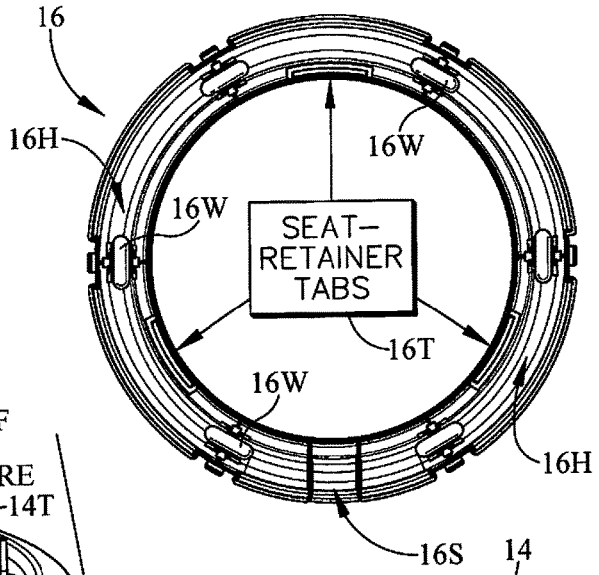
FIG. 7 is an enlarged bottom view of the rotatable seat of FIG. 6 showing a seat ring and six sets of wheels that are mounted in the seat ring and arranged to roll on an annular wheel-support track formed in the elevated seat-support platform as shown in FIG. 6 to support the seat for rotation relative to the elevated seat-support platform about the vertical seat-rotation axis also shown in FIG. 6.

Rotatable seat 16 is configured to be mounted in an upwardly opening seat receiver 14R that is formed in a central portion of elevated seat-support platform 14 as suggested in FIG. 6 so that rotatable seat 16 can be rotated about vertical seat-rotation axis 16A as suggested, for example, in FIGS. 2 and 3 when seat-rotation blocker 20 is placed in the SEAT-ROTATING MODE to disengage movable bolt 20B from rotatable seat 16. Rotatable seat 16 includes a frame 16F and six wheels 16W mounted for rotation in a hollow space 16H provided in frame 16F as suggested in FIGS. 6 and 7. Rotatable seat 16 also includes three elastic retainer tabs 16T cantilevered to frame 16F and configured to mate with and ride on a tab-engaging rim edge 14E included in seat-support platform 14 as suggested in FIGS. 6-9. Retainer tabs 16T ride on a rail provided by the rim edge 14E during rotation of seat 16 about vertical seat-rotation axis 16A. Any suitable child holder (not shown) can be coupled to frame 14F to hold a child seated in rotatable seat 16.

Figure 8:
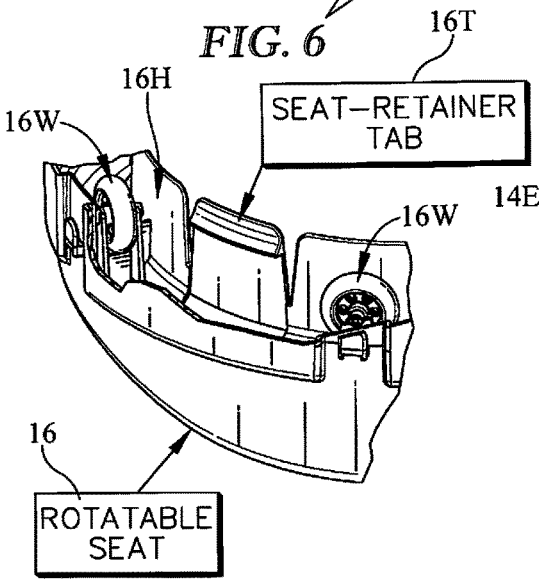
FIG. 8 is an enlarged perspective view of a portion of the rotatable seat showing one of the three circumferentially spaced apart seat-retainer tabs illustrated in FIG. 7.
Figure 9:
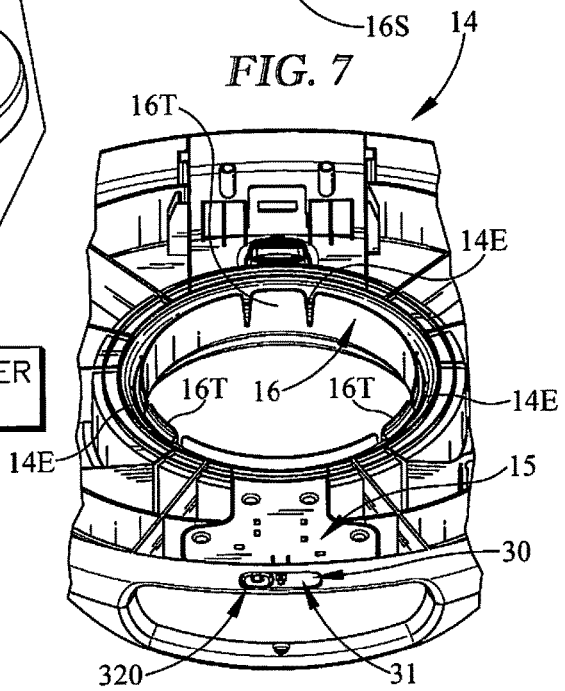
FIG. 9 is an enlarged perspective view of a portion of the underside of the seat-support platform of FIG. 6 after the rotatable seat of FIG. 7 has been mounted for rotation in the ring-shaped seat receiver shown in FIG. 6 and showing that the three seat-retainer tabs engage an inner edge of the elevated seat-support platform to keep the rotatable seat in the ring-shaped seat receiver yet allow the seat to rotatable relative to the elevated seat-support platform about the vertical seat-rotation axis.
Figure 10:
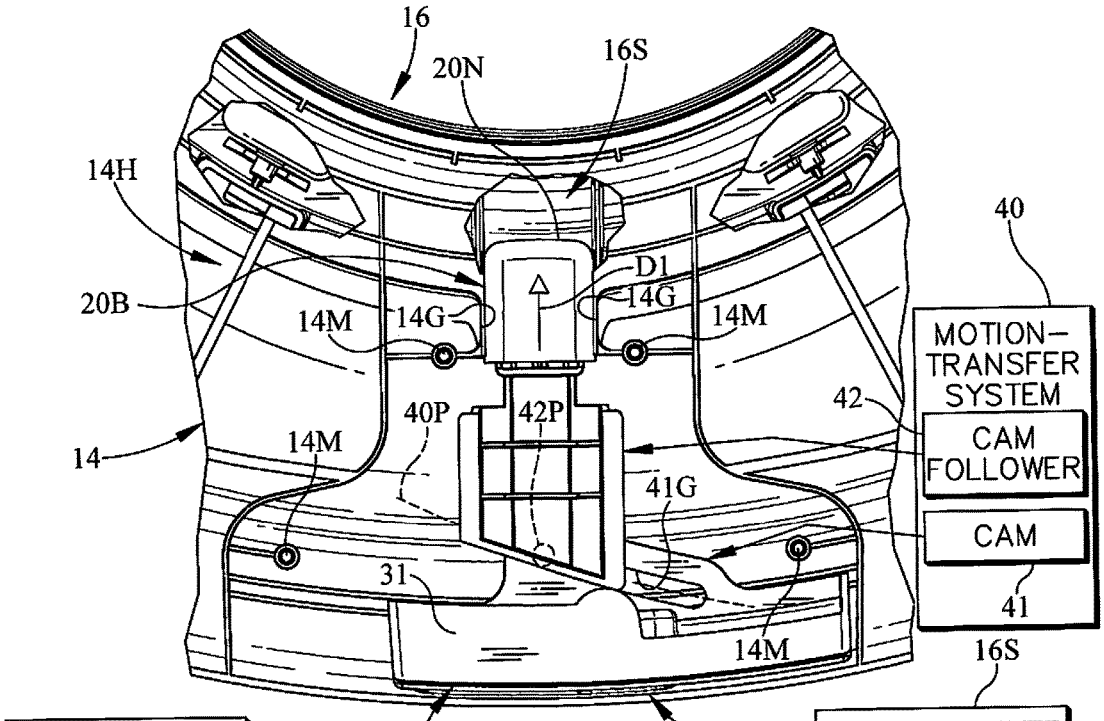
FIG. 10 is view taken along line 10-10 with portions broken away showing the seat-rotation blocker of FIG. 2 in the SEAT-LOCKING MODE.

Rotatable seat 16 is formed to include a radially outwardly opening bolt-receiver slot 16S as suggested diagrammatically in FIG. 4 and illustratively in FIGS. 5 and 8. Seat frame 16F is formed to include bolt-receiver slot 16S as shown, for example, in FIGS. 10 and 11. Bolt-receiver slot 16S is sized to receive a radially inwardly extending nose portion 20N of movable bolt 20B therein when seat 16 is rotated to a forward-facing position as shown in FIG. 1 and when seat-rotation blocker 20 is placed by the caregiver in the SEAT-LOCKING MODE as shown, for example, in FIGS. 10-13.

Figure 11:
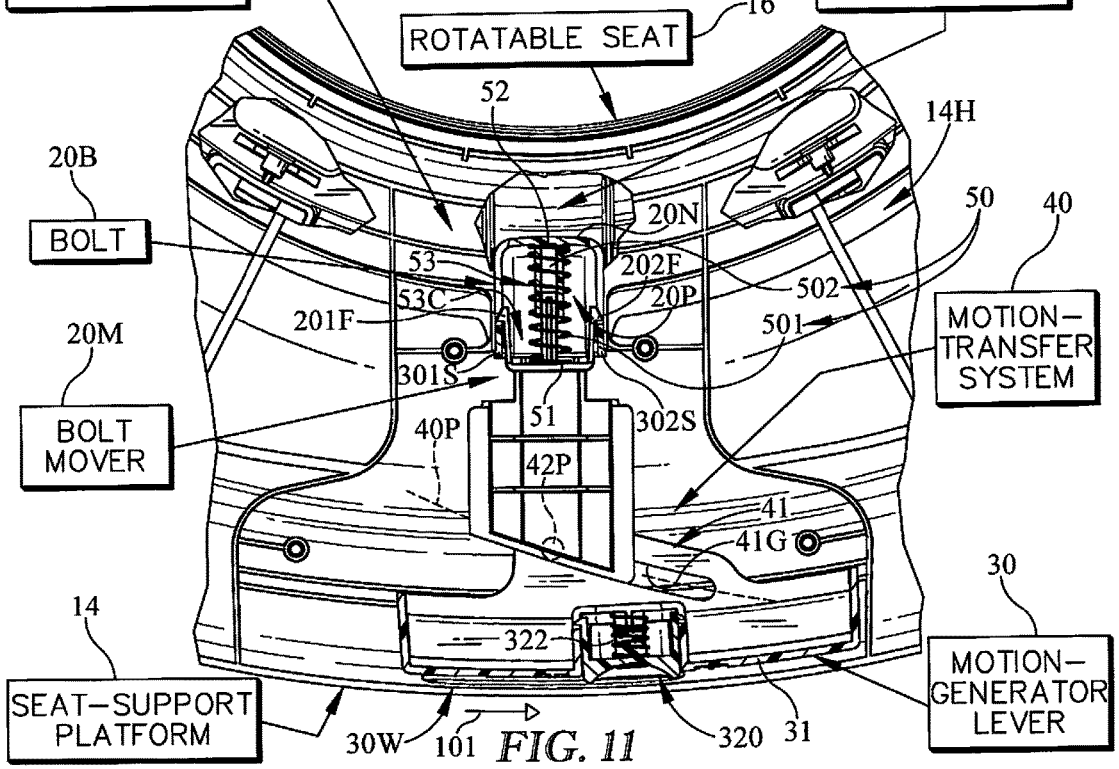
FIG. 11 is a view similar to FIG. 10 but with portions broken away to show a spring included in the bolt pusher (as suggested diagrammatically in FIG. 4) and insertion of the bolt into a bolt-receiver slot formed in the rotatable seat when the seat occupies a forward-facing position.
Figure 12:
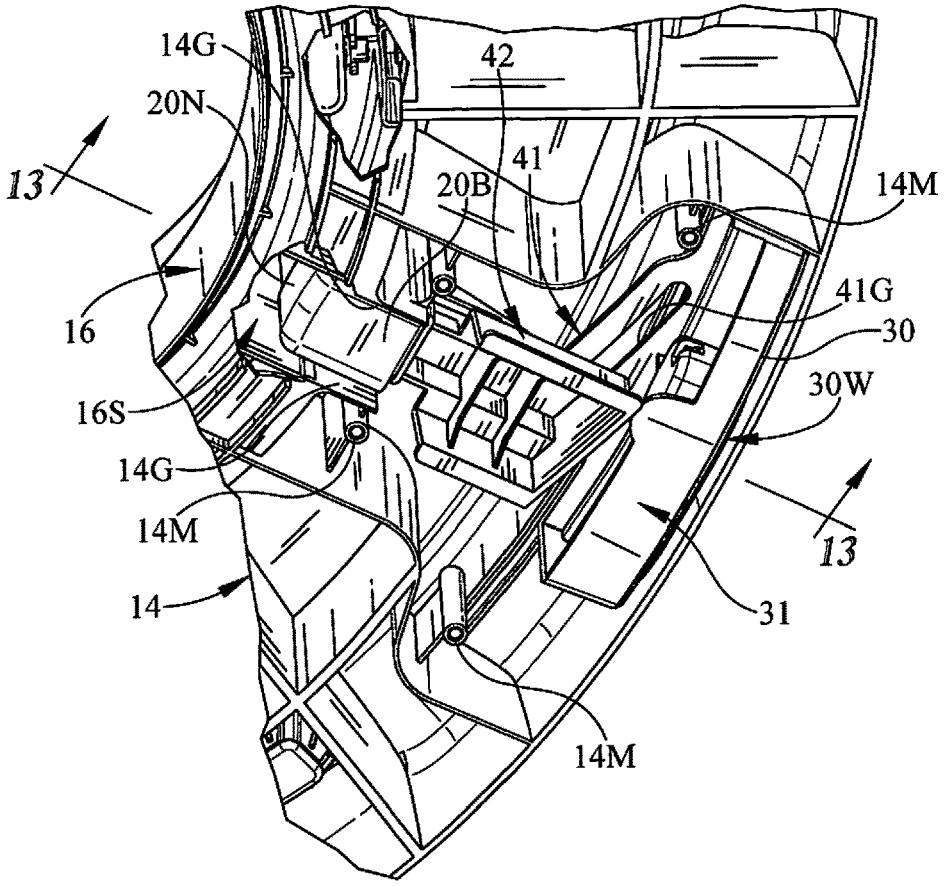
FIG. 12 is an enlarged partial perspective view of the underside of the child carrier with portions broken away showing the seat-rotation blocker is in the SEAT-LOCKING MODE.
Figure 13:
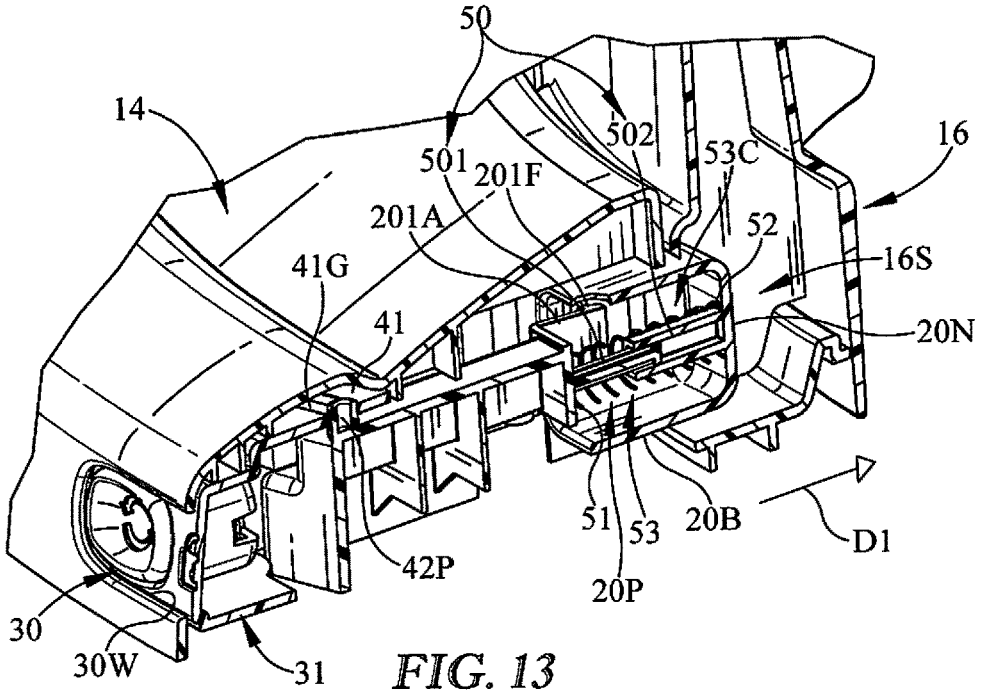
FIG. 13 is a view taken along line 13-13 of FIG. 12 when the seat-rotation blocker is in the SEAT-LOCKING MODE.

Seat-rotation blocker 20 also includes a bolt mover 20M that is coupled to movable bolt 20B as suggested diagrammatically in FIG. 1 and illustratively in FIGS. 5, 11, and 13. Bolt mover 20M is used to move bolt 20B relative to elevated seat-support platform 14 either to engage rotatable seat 16 to establish the SEAT-LOCKING MODE or to disengage rotatable seat 16 to establish the SEAT-ROTATING MODE. It is within the scope of the present disclosure to incorporate seat-rotation blocker 20 in a juvenile holder comprising a rotatable seat mounted for a rotation on a stationary frame.

Bolt mover 20M includes a bolt pusher 20P and a bolt retractor 20R as suggested in FIG. 1. Bolt pusher 20P is used to push movable bolt 20B into a bolt-receiver slot 16S formed in rotatable seat 16 when seat 16 occupies a forward-facing position as suggested in FIGS. 4, 11, and 13 to establish the SEAT-LOCKING MODE of seat-rotation blocker 20. Bolt retractor 20R is used to retract the radially inwardly extending nose portion 20N of movable bolt 20B from the bolt-receiver slot 16S formed in rotatable seat 16 as suggested in FIGS. 4, 15, and 17 to free seat 16 to rotate about vertical seat-rotation axis 16A and thereby establish the SEAT-ROTATING MODE of seat-rotation blocker 20.

Seat 16 can be locked to elevated seat-support platform 14 only when seat 16 occupies a predetermined forward-facing position in which a seated child faces directly forward as suggested in FIG. 1. Bolt-receiver slot 16S is formed in the back of the rotatable seat 16 as suggested in FIGS. 5 and 10. Movable bolt 20B of seat-rotation blocker 20 is spring-loaded so that movable bolt 20B is always yieldably urged in a radially inward direction by a spring 53 included in bolt pusher 20P of bolt mover 20M. If seat 16 occupies the predetermined forward-facing position then bolt-receiver slot 16S will be aligned with the radially inwardly extending nose 20N of movable bolt 20B as shown, for example, in FIGS. 10 and 11 and spring 53 will push movable bolt 20B into bolt-receiver slot 16S and seat 16 will be locked against rotation. If seat 16 is in any other position on elevated seat-support platform 14, spring 53 will compress but movable bolt 20B will be unable to move radially inwardly toward the vertical seat-rotation axis 16A.

Seat-rotation blocker 20 further includes a bolt-mover actuator 20A that is used by a caregiver to actuate bolt mover 20M so that bolt mover 20M functions: (1) to push movable bolt 20B into the aligned bolt-receiver slot 16S formed in frame 16F of rotatable seat 16 when seat 16 has been rotated to assume a predetermined forward-facing position and it is desired to block rotation of rotatable seat 16 about vertical seat-rotation axis 16A and (2) to retract movable bolt 20B from the bolt-receiver slot 16S formed in rotatable seat 16 when it is desired to allow rotation of rotatable seat 16 about vertical seat-rotation axis 16A. When bolt-mover actuator 20 is used by a caregiver to actuate bolt mover 20M when seat 16 does not occupy the predetermined forward-facing position, movable bolt 20B will be spring-biased to engage the aligned bolt-receiver slot 16S formed in seat 16 once seat 16 is rotated to assume the predetermined forward-facing position. This means the caregiver does not need to hold seat 16 in the forward-facing position while actuating bolt mover 20M to move bolt 20B into the aligned bolt-receiver slot 16S formed in seat 16. Bolt-mover actuator 20A includes a motion-generator lever 30 and a motion-transfer system 40 as shown diagrammatically in FIGS. 1 and 4 and illustratively in FIGS. 5, 11, and 15.

Motion-generator lever 30 of bolt-mover actuator 20A is mounted in an interior region of elevated seat-support platform 14 so that it is accessible by a caregiver via a lever-access window 30W formed in elevated seat-support platform 14 as suggested in FIGS. 2A and 3A. Motion-generator lever 30 is exposed in lever-access window 30W so that it can be gripped by a caregiver and moved by the caregiver relative to elevated seat-support platform 14 in a first direction 101 to establish the SEAT-LOCKING MODE of the seat-rotation blocker 20 as suggested in FIG. 2A. Motion-generator lever 30 can be moved in an opposite second direction 102 to establish the SEAT-ROTATING MODE of seat-rotation blocker 20 as suggested in FIG. 3A.

Motion-transfer system 40 of bolt-mover actuator 20A is configured to move bolt 20B relative to elevated seat-support platform 14 and rotatable seat 16 in response to movement of motion-generator lever 30 by the caregiver relative to elevated seat-support platform 14 as suggested in FIGS. 11, 13, 15 and 17. Motion-transfer system 40 is arranged to interconnect motion-generator lever 30 to movable bolt 20B so that bolt 20B is moved by bolt mover 20M in response to movement of the motion-generator lever 30 relative to elevated seat-support platform 14. In an illustrative embodiment motion-transfer system 40 uses a cam 41 that is coupled to the motion-generator lever 30 to move therewith and a cam follower 42 that is engaged to cam 41 and coupled to bolt mover 20M to transfer motion from motion-generator lever 30 to bolt mover 20M so that it can be applied to movable bolt 20B. As suggested in FIGS. 10 and 11, bolt mover 20M is moved radially inwardly relative to seat-support platform 14 toward vertical seat-rotation axis 16A to cause movable bolt 20B to be extended into bolt-receiver slot 16S of rotatable seat 16 in response to sliding movement of motion-generator lever 30 in first direction 10. As suggested in FIGS. 14 and 15, bolt mover 20M is moved radially outwardly relative to seat-support platform 14 away from vertical seat-rotation axis 16A to cause movable bolt 20B to be retracted from bolt-receiver slot 16S of rotatable seat 16 in response to sliding movement of motion-generator lever 30 in an opposite second direction 102.

Figures 14, 15:
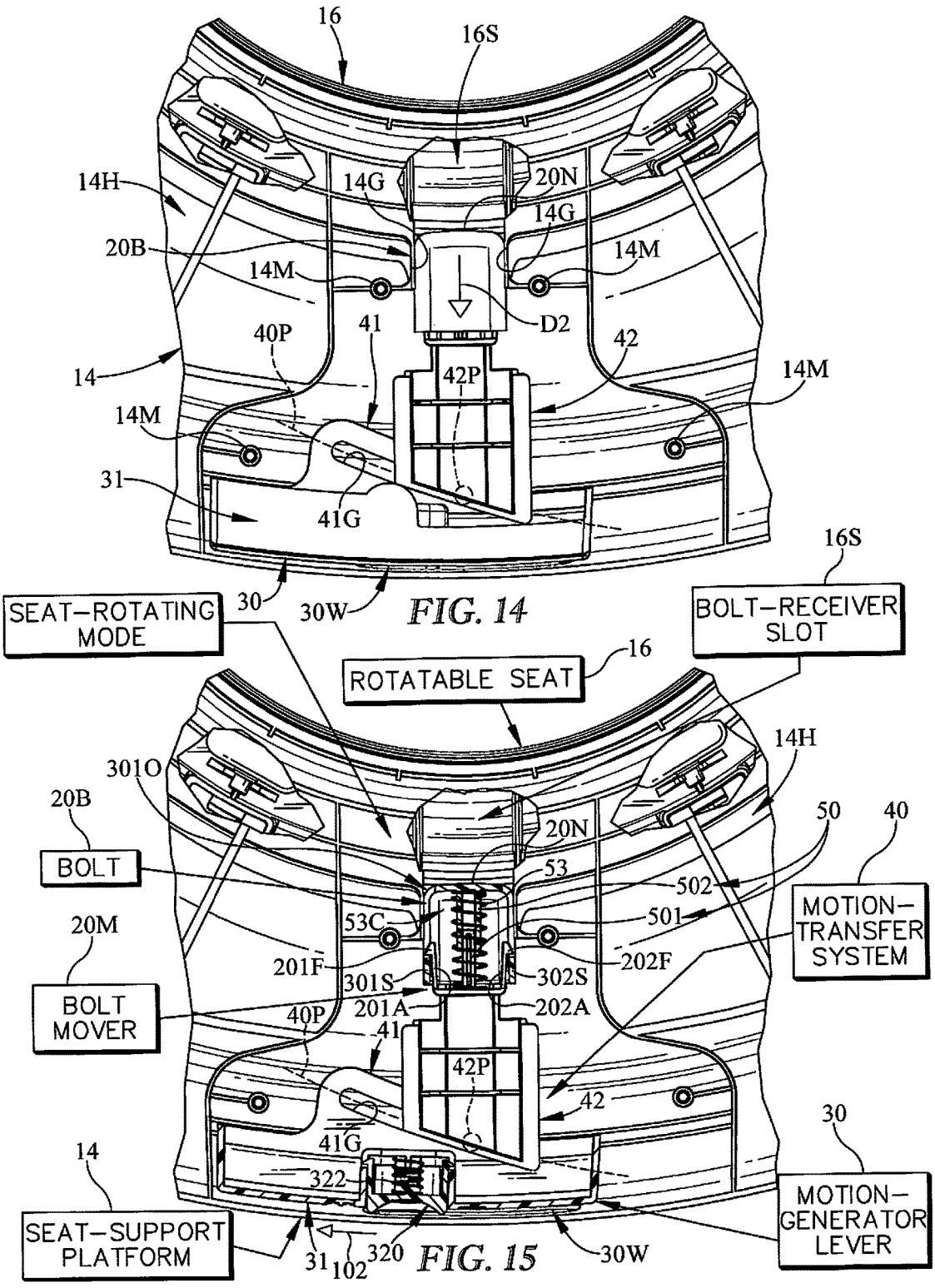
FIG. 14 is a view taken along line 14-14 with portions broken away showing the seat-rotation blocker of FIG. 3 in the SEAT-ROTATING MODE.
FIG. 15 is a view similar to FIG. 14 but with portions broken away to show a spring included in the bolt pusher and withdrawal of the movable bolt by the bolt retractor from the bolt-receiver slot formed in the rotatable seat and to show that the motion-generator lever includes a slide, a push button, and a spring acting between the slide and the push button.
Figure 16:
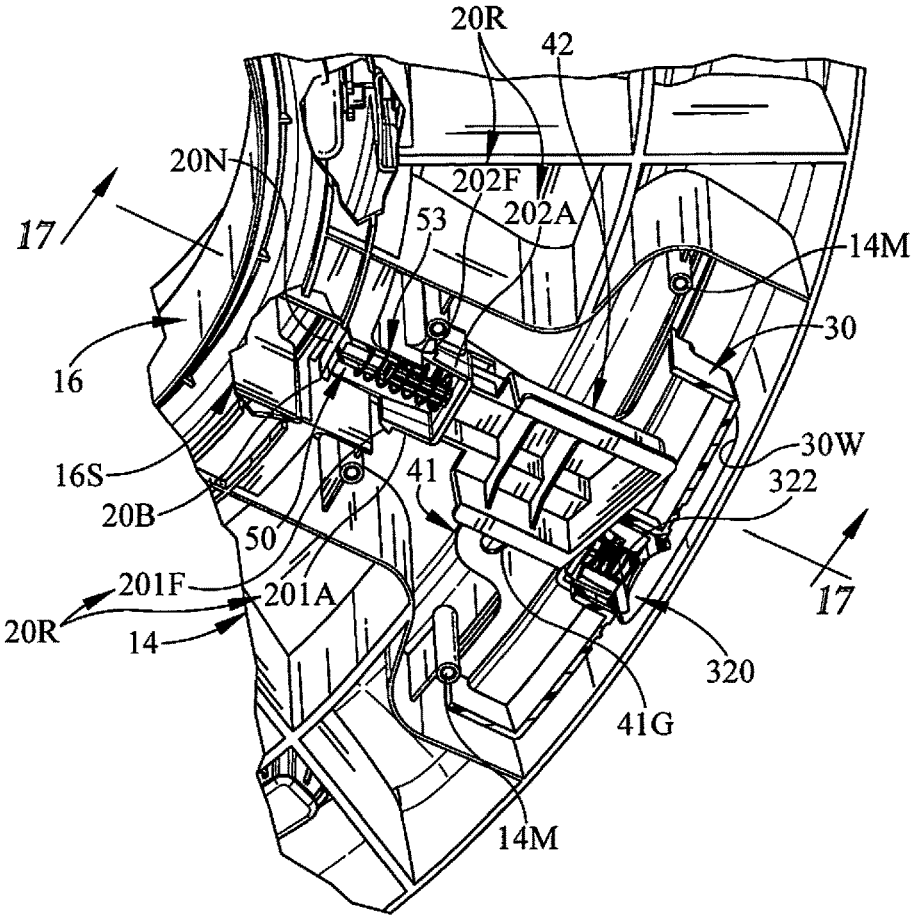
FIG. 16 is a view similar to FIG. 12 with portions broken away showing the seat-rotation blocker is in the SEAT-ROTATING MODE.

Motion-generator lever 30 includes a slide 31 that is mounted in an interior region formed in seat-support platform 14 for sliding movement relative to seat-support platform 14 as suggested in FIGS. 11 and 15 and a slide release 32 that is coupled to slide 31 and exposed in lever-access window 30W. Slide release 32 is arranged to extend outwardly through lever-access window 30W as suggested in FIGS. 2A and 3A. Slide release 32 is able to be moved relative to slide 31 and be operated by a caregiver to release the normally locked slide 31 so that slide 31 can be moved by the caregiver relative to elevated seat-support platform 14 to change seat-rotation blocker 20 from SEAT-LOCKING MODE to SEAT-ROTATING MODE.

Figure 18:
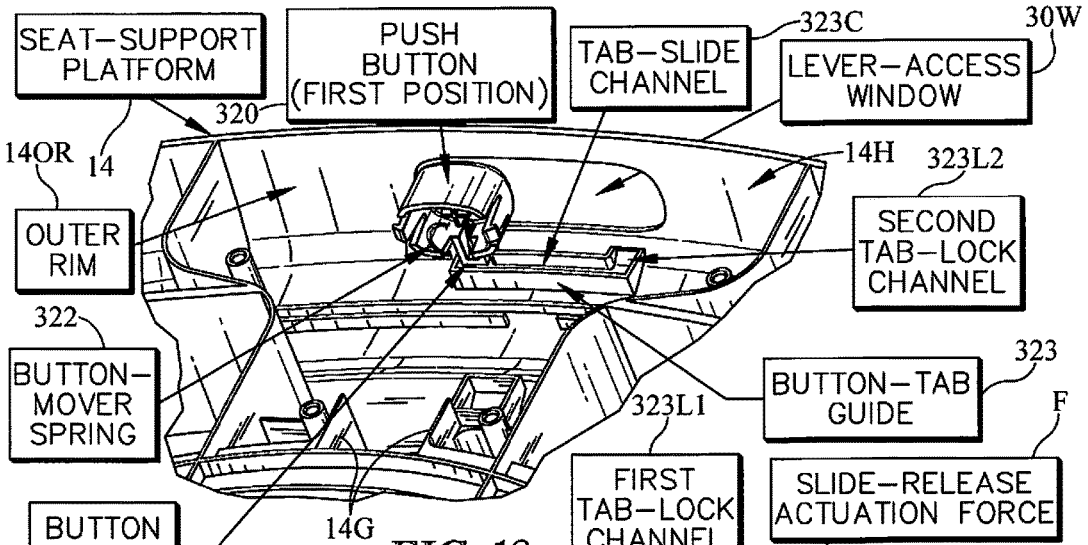
FIG. 18 is a perspective view of a portion of the elevated seat-support platform shown in FIG. 11 but from a different point of view with the movable bolt, bolt mover, and motion-transfer system removed and showing only the push button of the motion-generator lever as it is extended outwardly through the lever-access window formed in an outer rim of the elevated seat-support platform by the button-mover spring of the motion-generator lever when the seat-rotation blocker is in the SEAT-LOCKING MODE and showing that a button tab is coupled to the push button and arranged to extend into a U-shaped slot formed in a tab guide that is coupled to inner surface of the elevated seat-support platform and showing that the button tab is retained in a short first tab-lock channel formed in the tab guide to block sliding motion of the push button in the lever-access window and place the seat-rotation blocker is in SEAT-LOCKING MODE.
Figure 19:
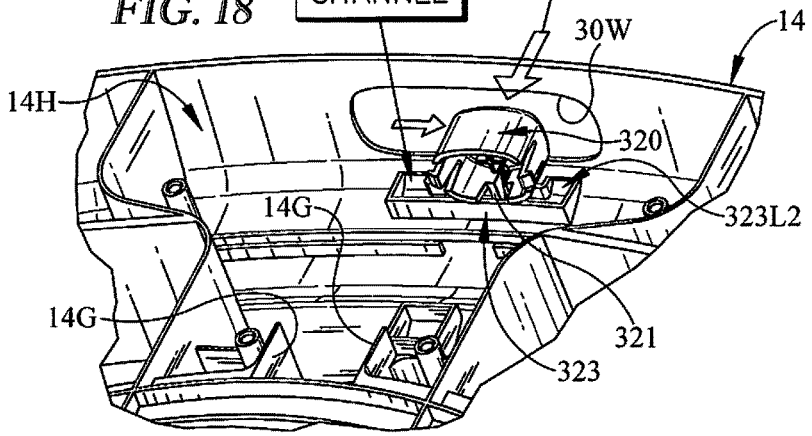
FIG. 19 is a view similar to FIG. 18 showing that a caregiver has applied an inward force ($F_1$) to the push button to cause the push button to exit the first tab-lock channel to allow the push button to be moved laterally in the lever-access window to place the seat-rotation blocker in SEAT-ROTATING MODE while the button tab is moved from left to right in a long tab-motion channel that is formed in the tab guide to interconnect the laterally spaced-apart first and second tab-lock channels.
Figure 20:
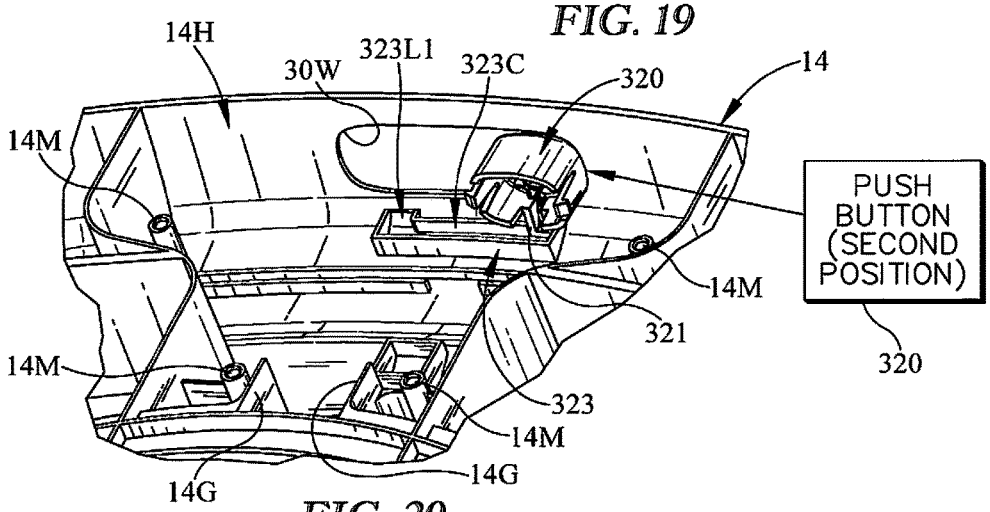
FIG. 20 is a view similar to FIGS. 18 and 19 showing that the button-mover spring functions to move the push button outwardly through the lever-access window once the button tab arrives at the mouth of the short second tab-lock channel to cause the button tab to move outwardly into the second tab-lock channel to block further lateral motion of the push button in the lever-access window and place the seat-rotation blocker (once again) in SEAT-LOCKING MODE.

Slide release 32 is configured normally to block sliding movement of slide 31 relative to elevated seat-support platform 14 when slide 31 occupies a first slide position shown in FIGS. 2A and 20 when seat-rotation blocker 20 is placed by the caregiver in the SEAT-LOCKING MODE and when slide 31 occupies a second slide position shown in FIGS. 3A and 18 when seat-rotation blocker 20 is placed by the caregiver in the SEAT-ROTATING MODE. However, when slide release 32 is actuated by a caregiver (e.g. by pushing inwardly on a push button 320 included in slide release 32) as suggested in FIG. 19, then slide 31 is released and freed to be moved by the caregiver relative to elevated seat-support platform 14 between the first slide position shown in FIGS. 2A and 18 and associated with the SEAT-LOCKING MODE of seat-rotation blocker 20 and the second slide position shown in FIGS. 3A and 20 and associated with the SEAT-LOCKING MODE of seat-rotation blocker 20.

Slide release 32 of motion-generator lever 30 includes a push button 320, a button tab 321 coupled to push button 320 to move therewith, a button-mover spring 322, and a button-tab guide 323 coupled to an inner wall of elevated seat-support platform 14 in a location near the lever-access window 30W as shown, for example, in FIG. 5. Button-tab guide 323 is formed to include a U-shaped slot comprising a long tab-slide channel 323C that interconnects the relatively short and laterally spaced apart first and second tab-lock channels 323L1, 323L2 as shown in FIGS. 10-20. When push button 320 is arranged as shown in FIG. 18, button-mover spring 322 acts against slide 31 to move push button 320 in a radially outward direction to move button tab 321 into first tab-lock channel 323L1 to block sliding motion of slide 31 in first direction 101. When push button 320 is arranged as shown in FIG. 20, button-mover spring 322 acts against slide 31 to move push button 320 in a radially outward direction to move button tab 321 into second tab-lock channel 323L2 to block sliding motion of slide 31 in second direction 102. However, slide 31 can be released for sliding motion relative to elevated seat-support platform 14 in response to inward pushing of push button 320 by a caregiver to compress button-mover spring 322 enough to cause button tab 321 to exit either the first or second tab-lock channels 323L1, 323L2 so that button tab 321 is free to move laterally back and forth in the relatively long tab-slide channel 323C formed in button-tab guide 323 as suggested in FIG. 19.

As suggested in FIG. 19, a caregiver has applied an inward slide-release actuation force (F) to push button 320 to cause push button 320 to exit first tab-lock channel 323L1 to allow push button 320 to be moved laterally in lever-access window 30W and slide 31 to slide relative to elevated seat-support platform 14 to place seat-rotation blocker 20 in SEAT-ROTATING MODE while button tab 321 is moved from left to right in a long tab-motion channel 323C that is formed in tab guide 323 to interconnect the laterally spaced-apart first and second tab-lock channels 323L1, 323L2.

Button-mover spring 322 functions as suggested in FIG. 20 to move push button 320 outwardly through lever-access window 30W once button tab 321 arrives at the mouth of the short second tab-lock channel 323L2. This outward movement of push button 320 causes button tab 321 to move outwardly into second tab-lock channel 323L2 to block further lateral motion of push button 320 in lever-access window 30W and sliding movement of slide 31 thereby placing and place seat-rotation blocker 20 (once again) in SEAT-LOCKING MODE.

Motion-transfer system 40 includes a cam 41 that is coupled to slide 31 of motion-generator lever 30 to move therewith and a cam follower 42 that is coupled to bolt mover 20M to move therewith as suggested diagrammatically in FIG. 4 and illustratively in FIG. 5. Cam follower 42 moves somewhat diagonally along a diagonally extending arcuate path 40P relative to seat-support platform 14 in response to movement of slide 31 of motion-generator lever 30 relative seat-support platform 14 so as to cause bolt mover 20M to move bolt 20B into or out of the bolt-receiver slot 16S formed in rotatable seat 16 as suggested in FIGS. 11 and 15. Sliding movement of slide 31 in the first direction 101 causes bolt pusher 20P of bolt mover 20M to push movable bolt 20B in a radially inward direction into the bolt-receiver slot 16S that is formed in rotatable seat 16 to engage movable bolt 20B to rotatable seat 16 so as to establish the SEAT-LOCKING MODE when bolt 20B and bolt-receiver slot 16S are aligned as suggested in FIG. 11. Sliding movement of slide 31 in the opposite second direction 102 causes bolt retractor 20R of bolt mover 20M to retract movable bolt 20B in an opposite radially outward direction out of the bolt-receiver slot 16S formed in rotatable seat 16 to disengage movable bolt 20B from rotatable seat 16 so as to establish the SEAT-ROTATING MODE as suggested in FIG. 15.

Cam 41 of motion-transfer system 40 is an inverse-cam plate formed to include a pin-receiving groove 41G as shown, for example, in FIG. 5. Pin-receiving groove 41G is curved to establish the diagonally extending arcuate (pin-motion) path 40P shown in FIGS. 11 and 15.

Cam follower 42 of motion-transfer system 40 includes a pin support 42S and pin 42P as suggested diagrammatically in FIG. 4 and illustratively in FIG. 5. Pin 42P is arranged to extend upwardly into the pin-receiving groove 41G formed in cam 41 as suggested in FIGS. 5, 13, and 17. When cam 41 moves back and forth in response to back-and-forth movement of slide 31 in first direction 101 or second direction 102, cam 41 moves pin 42P of cam follower 42 as suggested in FIGS. 11 and 15 to transfer motion from slide 31 of motion-generator lever 30 to the bolt mover 20M that is coupled to cam follower 42 as suggested in FIGS. 11 and 15.

Bolt mover 20M includes a bolt pusher 20P that is coupled to pin support 42S of cam follower 42 and a bolt retractor 20R that is also coupled to pin support 42S of cam follower 42 as shown diagrammatically in FIG. 4 and illustratively in FIG. 5. As suggested in FIGS. 11 and 13, sliding movement of slide 31 of motion-generator lever 30 in the first direction 101 causes cam follower 42 to move radially inwardly toward vertical seat-rotation axis 16A to cause radially inward movement of bolt pusher 20P of bolt mover 20M so that movable bolt 20B is pushed into the bolt-receiver slot 16S formed in frame 16H of rotatable seat 16 when movable bolt 20B and bolt-receiver slot 16S are aligned in confronting relation to one another as suggested in FIG. 11. In contrast, as suggested in FIGS. 15 and 17, sliding movement of slide 31 of motion-generator lever 30 in the opposite second direction 102 causes cam follower 42 to move radially outwardly away from vertical seat-rotation axis 16A to cause radially outward movement of bolt retractor 20R of bolt mover 20M so that movable bolt 20B is withdrawn from the bolt-receiver slot 16S formed in frame 16H of rotatable seat 16 as suggested in FIG. 15.

Bolt pusher 20P of bolt mover 20M includes a spring mount 50 coupled at one end to pin support 42S of cam follower 42 and a spring 53 mounted on spring mount 50 as suggested diagrammatically in FIG. 4 and illustratively in FIGS. 5, 11, 13, 15, and 17. An outer end 51 of spring 53 engages an outer actuator wall of bolt-mover actuator 20A that is provided by pin support 42S of cam follower 42 and an inner end 52 of spring 53 engages an inner wall of movable bolt 20B as shown, for example, in FIGS. 11 and 13. Spring 53 is located in a hollow spring-receiver chamber 53C formed in movable bolt 20B as shown, for example, in FIGS. 11, 13, 15, and 17. Spring 53 is a compressible coiled compression spring that is helically wound around spring mount 50. Spring mount 50 illustratively comprises a first or outer rod 501 and a companion second or inner rod 502 as shown in FIGS. 11 and 13. First rod 501 is cantilevered to an outer wall of pin support 42S and arranged to extend telescopically into a rod-receiver 501R formed in second rod 502. Second rod 502 is cantilevered to the inner wall of movable bolt 20B.

Figure 17:
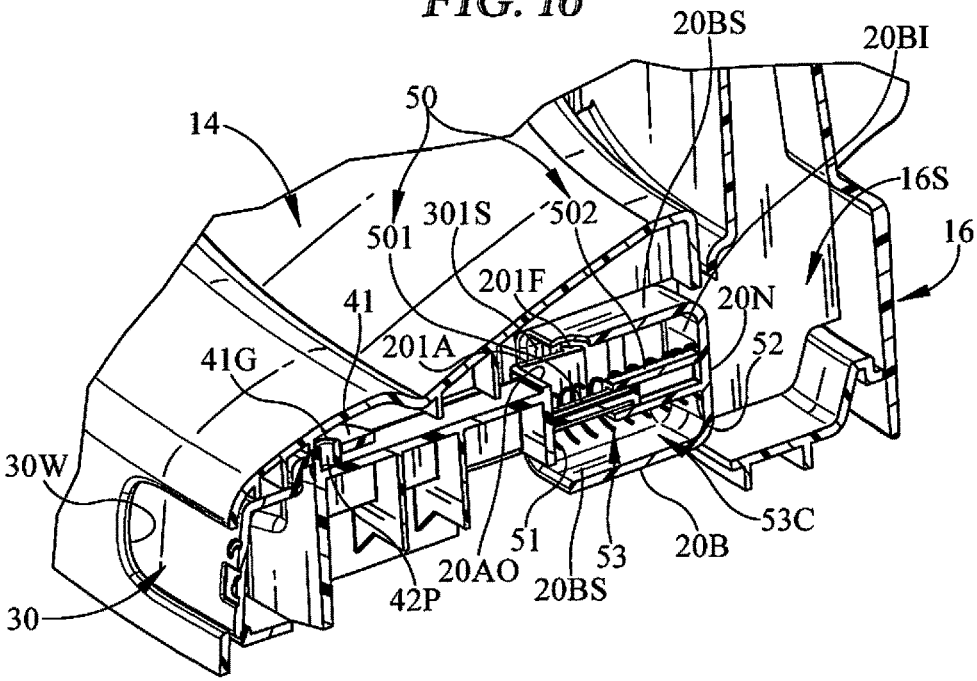
FIG. 17 is a view similar to FIG. 13 when the seat-rotation blocker is in the SEAT-ROTATING MODE.

Bolt retractor 20R includes a first puller flange 201F that is coupled to a first arm 201A that is mounted on the outer actuator wall of bolt-mover actuator 20A that is provided by pin support 42S of cam follower 42 as suggested diagrammatically in FIG. 4 and illustratively in FIG. 5. In an illustrative embodiment shown in FIG. 5, bolt retractor 20R also includes a second puller flange 202F that is coupled to a second arm 202A that is mounted on the outer actuator wall of bolt-mover actuator 20A that is provided by pin support 42S of cam follower 42 and arranged to lie in spaced-apart parallel rotation to first arm 201A as shown in FIG. 5 to locate a portion of spring 53 therebetween as shown in FIG. 17. Each of first and second arms 201A, 202A is cantilevered to the outer actuator wall of pin support 42S. Each of first and second puller flanges 201F, 202F is arranged to engage companion flange-engagement strips 301S, 302S included in movable bolt 20B as shown, for example, in FIG. 17.

Juvenile walker 10 comprises a rolling platform-elevation base 18 and a child carrier 12 including an elevated seat-support platform 14 and a rotatable seat 16 as shown, for example, in FIG. 1. The seat 16 is mounted for 360° rotation in a central opening formed in seat-support platform 14 as suggested in FIGS. 1 and 6. Seat-support platform 14 is mounted in an elevated position on the rolling platform-elevation base 18 to allow a caregiver to rotate seat 16 about a vertical seat-rotation axis 16A to change the rotated orientation of seat 16 relative to the elevated seat-support platform 14 as suggested in FIGS. 1-3.

Juvenile walker 10 also includes a seat-rotation blocker 20 that is coupled to elevated seat-support platform 14 to move therewith and can be used by a caregiver to block rotation of seat 16 about the vertical seat-rotation axis 16A relative to the elevated seat-support platform 14 when seat 16 occupies a predetermined forward-facing position as suggested in FIGS. 2, 2A and 11. Seat-rotation blocker 20 includes a movable bolt 20B that can be moved relative to the elevated seat-support platform 14 (1) to engage the rotatable seat 16 so that rotation of seat 16 about vertical seat-rotation axis 16A relative to elevated seat-support platform 14 is blocked and (2) to disengage the rotatable seat 16 so that seat 16 is allowed to rotate about vertical seat-rotation axis 16A relative to elevated seat-support platform 14 as suggested in FIGS. 3, 3A, and 15.

A bolt cover 15 is also included in juvenile walker 10 as suggested in FIG. 5. Bolt cover 15 can be coupled to fastener mounts 14M of elevated seat-support platform 14 shown in FIGS. 10 and 14 using fasteners (not shown) to cover movable bolt 20B, motion-generator lever 30, and motion-transfer system 40 as suggested in FIGS. 5 and 9.

Seat-rotation blocker 20 further includes a bolt mover 20M located in a hollow region 14H formed in elevated seat-support platform 14 and coupled to movable bolt 20B and a bolt-mover actuator 20A that can be accessed and operated by a caregiver to cause bolt mover 20M to push movable bolt 20B to a seat-engaging position to block seat rotation as suggested in FIGS. 2, 2A, and 11 or the retract movable bolt 20B to a seat-disengaging position to allow seat rotation as suggested in FIGS. 3, 3A, and 15. The bolt-mover actuator 20A includes a motion-generator lever 30 that extends outwardly through a lever-access window 30W that is formed in elevated seat-support platform 14 so that the motion-generator lever 30 can be gripped by the caregiver and moved relative to the elevated seat-support platform 14. Bolt-mover actuator 20A also includes a motion-transfer system 40 that functions to convert motion generated by motion-generator lever 30 into movement of movable bolt 20B relative to elevated seat-support platform 14 between the seat-engaging position and the seat-disengaging position.

Motion-generator lever 30 extends through a lever-access window 30W formed in a rear portion of an outer rim 14OR of elevated seat-support platform 14 so that it can be finger-gripped by a caregiver. The caregiver can slide motion-generator lever 30 to the left relative to elevated seat-support platform 14 to place seat-rotation blocker 20 in a SEAT-LOCKING MODE and, alternatively, to the right to place seat-rotation blocker 20 in SEAT-ROTATING MODE.

Motion-transfer system 40 includes a cam 41 coupled to motion-generator lever 30 and a cam follower 42 coupled to bolt mover 20M. To assume the SEAT-LOCKING MODE, movement of motion-generator lever 30 to the left causes cam 41 to move cam follower 42 toward seat 16 so that bolt pusher 20P is also moved toward the seat 16 to push movable bolt 20B to the seat-engaging position and thereby block rotation of seat 16 about vertical seat-rotation axis 16A relative to elevated seat-support platform 14. To assume the SEAT-ROTATING MODE, movement of motion-generator lever 30 back to the right causes cam 41 to move cam follower 42 away from seat 16 so that bolt retractor 20R is also moved away from seat 16 to retract movable bolt 20B to the seat-disengaging position and thereby free seat 16 to be rotated about vertical seat-rotation axis 16A relative to elevated seat-support platform 14.

Seat 16 rotates using six wheels 16W located on the bottom of seat frame 16H as suggested in FIGS. 6-9. Each wheel 16W snaps into seat frame 16H through two snap features located on the sides of the wheel 16W as suggested in FIGS. 7 and 8. The wheels 16W spin on a circular track on a circular tray 14T included in seat-support platform 14.

Seat 16 is inserted into tray 14T as suggested in FIG. 6 by lining the seat 16 with the seat receiver 14R formed in elevated seat-support platform 14. Seat 16 remains on tray 14T via the seat-retainer tabs 16T as suggested in FIG. 9. To release seat 16 from tray 14T the tips of the elastic seat-retainer tabs 16T are pushed inwardly toward vertical seat-rotation axis 16A to disengage elevated seat-support platform 14 and seat 16 is removed.

Juvenile walker 10 comprises a rolling platform-elevation base 18 adapted to roll on an underlying surface and a child carrier 12 including an elevated seat-support platform 14 mounted on the rolling platform-elevation base 18 and a rotatable seat 16 mounted for rotation on elevated seat-support platform 14 about a vertical seat-rotation axis 16A as shown in FIG. 1. Juvenile walker 10 also includes a seat-rotation blocker 20 including a movable bolt 20B, a bolt-mover actuator 20A, and a bolt mover 20M coupled to bolt-mover actuator 20A and movable bolt 20B and supported for movement relative to elevated seat-support platform 14 as suggested in FIGS. 1 and 4.

Movable bolt 20B is arranged to be moved relative to elevated seat-support platform 14 in a first direction D1 to extend into a bolt-receiver slot 16S formed in rotatable seat 16 as shown in FIGS. 10-13 to assume a seat-locking position engaged to rotatable seat 16 to block rotation of rotatable seat 16 relative to elevated seat-support platform 14 about vertical seat-rotation axis 16A to establish a seat-blocking mode of seat-rotation blocker 20. Movable bolt 20B is also arranged to be moved in an opposite second direction D2 to exit the bolt-receiver slot 16S formed in rotatable seat 16 as shown in FIGS. 14, 15, and 17 to assume a seat-rotating position disengaged from rotatable seat 16 to allow rotatable seat 16 to rotate relative to elevated seat-support platform 14 about vertical seat-rotation axis 16A to establish a seat-rotating mode of seat-rotation blocker 20.

Bolt mover 20M is arranged to push movable bolt 20B automatically into bolt-receiver slot 16S formed in rotatable seat 16 as suggested in FIGS. 11 and 13 when rotatable seat 16 is aligned in a predetermined position relative to elevated seat-support platform 14. Bolt mover 20M is also configured to withdraw movable bolt 20B from bolt-receiver slot 16S formed in rotatable seat 16 in response to movement of bolt-mover actuator 20A relative to elevated seat-support platform 14 about vertical seat-rotation axis 16A from a first actuator position shown in FIGS. 2, 2A, 10, and 11 and associated with the seat-locking mode of seat-rotation blocker 20 to a second actuator position shown in FIGS. 3, 3A, 15, and 17 and associated with the seat-rotating mode of the seat-rotation blocker 20. Bolt mover 20M includes a bolt pusher 20P suggested on FIG. 4 configured to provide means for yieldably urging movable bolt 20B into the bolt-receiver slot 16S formed in the rotatable seat 16 automatically as suggested in FIGS. 11 and 13 upon rotation of rotatable seat 16 about vertical seat-rotation axis 16A to the predetermined position while bolt-mover actuator 20A remains in the first actuator position associated with the seat-locking mode of seat-rotation blocker 20.

Elevated seat-support platform 14 has a forward portion 14F and an opposite rearward portion 14R as shown in FIGS. 2 and 3. Child carrier 12 further includes a push handle 14H coupled to the opposite rearward portion 14R of elevated seat-support platform 14 and configured to be gripped by an operator for use in pushing the rolling platform-elevation base 18 to roll on the underlying surface as suggested in FIG. 1.

Rotatable seat 16 includes a seat back 16B shown, for example, in FIGS. 1-3 and arranged to engage a back of a seated child seated in rotatable seat 16 during rotation of the rotatable seat 16 about vertical seat-rotation axis 16A in sequence from a left-facing position (not shown) first to a forward-facing position (shown in FIG. 2) that is coextensive with the predetermined position to orient the seated child to face toward the forward portion of elevated seat-support platform 14 and then to a right-facing position (shown in FIG. 3). Movable bolt 20B is supported for movement on elevated seat-support platform 14 so that movable bolt 20B is able to extend into the bolt-receiver slot 16S formed in the rotatable seat 16 only when rotatable seat 16 is rotated about vertical seat-rotation axis 16A to assume the forward-facing (predetermined) position as suggested in FIGS. 2 and 10-13.

Rotatable seat 16 is mounted in an upwardly opening seat receiver 14RE formed in a central portion of elevated seat-support platform 14 to allow rotatable seat 16 to be rotated about vertical seat-rotation axis 16A when seat-rotation blocker 20 is placed in the seat-rotating mode in which movable bolt 20B is disengaged from rotatable seat 16 as suggested in FIG. 3. As suggested in FIGS. 6-9, rotatable seat 16 includes a frame 16F, several wheels 16W mounted for rotation in a hollow space 16H provided in frame 16F during rotation of rotatable seat 16 about vertical seat-rotation axis 16A, and several elastic retainer tabs 16T cantilevered to frame 16F and configured to mate with and ride on a tab-engaging rim edge 14E included in elevated seat-support platform 14 during rotation of rotatable seat 16 about vertical seat-rotation axis 16A. Rotatable seat 16 also includes a suitable child holder (not shown) that is coupled to frame 16F to rotate therewith about vertical seat-rotation axis 16A.

The bolt-receiver slot 16S of rotatable seat 16 is oriented to open radially outwardly away from vertical seat-rotation axis 16A as suggested in FIGS. 2, 3, and 5 during rotation of rotatable seat 16 about vertical seat-rotation axis 16A. Bolt pusher 20P is configured to push a radially inwardly extending nose portion 20N of movable bolt 20B toward vertical seat-rotation axis 16A and into bolt-receiver slot 16S automatically when rotatable seat 16 is rotated about vertical seat-rotation axis 16A to assume the predetermined position as suggested in FIGS. 11 and 13. Elevated seat-support platform 14 is formed to include a pair of bolt-guide members 14G that are arranged as suggested in FIGS. 10, 12, and 14 to lie in spaced-apart parallel relation to the one another to guide movable bolt 20B along a radially extending path toward and away from vertical seat-rotation axis 16A during movement of movable bolt 20B into and out of the bolt-receiver slot 16S formed in rotatable seat 16.

Bolt pusher 20P includes a spring 53 arranged to interact between movable bolt 20B and bolt-mover actuator 20A as suggested in FIGS. 5, 11, and 13 to yieldably extend movable bolt 20B into the bolt-receiver slot 16S formed in rotatable seat 16 automatically when rotatable seat 16 is rotated about vertical seat-rotation axis 16A to assume the predetermined position. Spring 53 is located in a hollow chamber 53C formed in movable bolt 20B and includes an outer end 51 engaged to an outer actuator wall 20AO of bolt-mover actuator 20A and an inner end 52 engaged to an inner wall 20BI of movable bolt 20B providing a boundary of hollow chamber 53C as suggested in FIGS. 5, 11, 13, and 17.

Bolt pusher 20P further includes a spring mount 50 suggested in FIG. 4 and shown in FIGS. 13 and 17. Spring mount 50 comprises an inner rod 502 cantilevered to the inner wall 20BI of movable bolt 20B lie in hollow chamber 53C and to move with movable bolt 20B relative to rotatable seat 16 and an outer rod 501 cantilevered to the outer wall 20AO of bolt-mover actuator 20A and arranged to engage inner rod 502. Spring 53 is a coiled compression spring that is helically wound around the inner and outer rods 502, 501 of spring mount 50 as suggested in FIGS. 13 and 17.

Bolt-mover actuator 20A includes a motion-generator lever 30 and a motion-transfer system 40 as suggested in FIGS. 1 and 4 and shown in FIG. 5. Motion-generator lever 30 is arranged to be gripped by a caregiver and moved by the caregiver relative to elevated seat-support platform 14 in a first direction 101 to establish the seat-locking mode of seat-rotation blocker 20 as suggested in FIGS. 2A and 11 and in an opposite second direction 102 to establish the seat-rotating mode of seat-rotation blocker 20 as suggested in FIGS. 3A and 15. As suggested in FIGS. 5, 11, and 15, motion-transfer system 30 includes a cam 41 that is coupled to motion-generator lever 30 to move therewith and a cam follower 42 that is formed to include the outer actuator wall 20AO that engages outer end 52 of spring 53 included in bolt pusher 20P of bolt mover 20M and engaged to cam 41 and coupled to bolt mover 20M to transfer motion from motion-generator lever 30 to bolt mover 20M for application to movable bolt 20B via bolt mover 20M.

Movable bolt 20B further includes a side wall 20BS coupled to inner wall 20BI to form a boundary of hollow chamber 53C as suggested in FIG. 17. Bolt mover 20M further includes a bolt retractor 20R that is coupled to the outer actuator wall of bolt-mover actuator 20M and to side wall of movable bolt 20B to retain spring 53 in a compressed state between and in engagement with the outer wall 20AO of bolt-mover actuator 20A and inner wall 20BI of bolt mover 20M.

Side wall 20BS of movable bolt 20B is formed to a flange-receiving opening 301O bounded by a first flange-attachment strip 301S as shown in FIGS. 5 and 15. Bolt retractor 20R includes a first arm 201A and a first puller flange 201F as shown in FIG. 5. First arm 201A is cantilevered to the outer actuator wall 20AO of bolt-mover actuator 20A. First puller flange 201F is coupled to first arm 201A and arranged to extend into the flange-receiving opening 301O formed in side wall 20BS of movable bolt 20B and arranged to engage first flange attachment strip 301S to block movement of inner wall 20BI of movable bolt 20B away from the outer actuator wall 20AO of bolt-mover actuator 20A under a yieldable spring load applied to the outer and inner walls by spring 53.

Motion-generator lever 30 of bolt-mover actuator 20A is arranged to be gripped by a caregiver and moved by the caregiver relative to elevated seat-support platform 14 in a first direction 101 to establish the seat-locking mode of seat-rotation blocker 20 as suggested in FIG. 2A and in an opposite second direction 102 to establish the seat-rotating mode of seat-rotation blocker 20 as suggested in FIG. 3A. Motion-transfer system 40 of bolt-mover actuator 20A includes a cam 41 that is coupled to motion-generator lever 30 to move therewith and a cam follower 42 that is formed to include the outer actuator wall 20AO that engages bolt retractor 20R of bolt mover 20M and engaged to cam 41 and coupled to bolt mover 20M to transfer motion from motion-generator lever 30 to bolt mover 20M for application to movable bolt 20B via bolt mover 20M.

Bolt retractor 20R is configured to provide means for retracting a radially inwardly extending nose 20N of movable bolt 20B that extends toward vertical seat-rotation axis 16A from the bolt-receiver slot 16S formed in rotatable seat 16 as suggested in FIG. 15 to free rotatable seat 16 to rotate about vertical seat-rotation axis 16A while bolt-mover actuator 20A remains in the second actuator position associated with the seat-rotating mode of seat-rotation blocker 20. Movable bolt 20B is formed to include a hollow chamber 53C, a first flange-engagement strip 301S bordering hollow chamber 53C, and a second flange-attachment strip 302S bordering hollow chamber 53C as shown in FIG. 15. Bolt retractor 20R includes a first arm 201A cantilevered to an outer actuator wall 20AO of bolt-mover actuator 20A and a first puller flange 201F that is coupled to first arm 201A and arranged to engage first flange-engagement strip 301S to impart a radially outwardly directed retraction force to movable bolt 20B in response to movement of bolt-actuator mover 20A relative to elevated seat-support platform 14 from the first actuator position to the second actuator position. Bolt retractor 20R further includes a second arm 202A cantilevered to the outer actuator wall 20AO of bolt-mover actuator 20A and a second puller flange 202F that is coupled to second arm 202A and arranged to engage second flange-engagement strip 302S to impart another radially outwardly directed retraction force to movable bolt 20B in response to movement of bolt-actuator mover 20A relative to elevated seat-support platform 14 from the first actuator position to the second actuator position. Spring 53 of bolt pusher 20P is located in hollow chamber 53C formed in movable bolt 20B and arranged to lie midway between first and second arms 201A, 202A of bolt retractor 20R.

Bolt pusher 20P that is arranged to push movable bolt 20B into the bolt-receiver slot 16S formed in rotatable seat 16 when rotatable seat 16 has been rotated about vertical seat-rotation axis 16A to assume the predetermined position as suggested in FIGS. 11 and 13. Bolt retractor 20R is arranged to lie alongside bolt pusher 20P as suggested in FIGS. 4, 16, and 17 to retract movable bolt 20B from the bolt-receiver slot 16S formed in rotatable seat 16 in response to movement of bolt-mover actuator 20A relative to the elevated seat-support platform 14 to the second actuator position. Motion-generator lever 30 of bolt-mover actuator 20A is arranged to be gripped by a caregiver and moved by the caregiver relative to elevated seat-support platform 14 in a first direction 101 to establish the seat-locking mode of seat-rotation blocker 20 and in an opposite second direction 102 to establish the seat-rotating mode of seat-rotation blocker 20. Motion-transfer system 40 of bolt-mover actuator 20A is arranged to interconnect motion-generator lever 30 to movable bolt 20B. Motion-transfer system 40 is configured to provide means for transferring motion from motion-generator lever 30 to bolt mover 20M to move bolt mover 20M in a radially inward direction relative to elevated seat-support platform 14 toward vertical seat-rotation axis 16A to cause movable bolt 20B to be extended into bolt-receiver slot 16S formed in rotatable seat 16 in response to sliding movement of motion-generator lever 30 in the first direction 101 and to move bolt mover 20M in a radially outward direction relative to elevated seat-support platform 14 away from vertical seat-rotation axis 16A to cause movable bolt 20B to be retracted from the bolt-receiver slot 16S formed in rotatable seat 16 in response to sliding movement of motion-generator lever 30 in the opposite second direction 102.

Motion-transfer system 40 includes a cam 41 that is coupled to motion-generator lever 30 to move therewith and a cam follower 42 that is engaged to cam 41 and coupled to bolt mover 20M to transfer motion from motion-generator lever 30 to bolt mover 20M for application to movable bolt 20B via bolt mover 20M. Cam 41 comprises an inverse-cam plate 41 formed to include a pin-receiving groove 41G as suggested in FIG. 4 and shown in FIG. 5. Cam follower 42 comprises a pin support 42S and a pin 42P as suggested in FIG. 4 and shown in FIG. 5. Pin support 42S is coupled to bolt mover 20M and arranged to move back and forth along a radially extending cam-follower path intersecting vertical seat-rotation axis 16A as suggested in FIGS. 11 and 15 during movement of movable bolt 20M into and out of the bolt-receiver slot 16S formed in rotatable seat 16. Pin 42P is coupled to pin support 42S and arranged to extend into the pin-receiving groove 41G formed in inverse-cam plate 41. Movement of inverse-cam plate 41 relative to elevated seat-support platform 14 in response to movement of motion-generator lever 30 relative to elevated seat-support platform 14 during movement of bolt-mover actuator 20A between the first and second actuator positions moves pin 42P in the pin-receiving groove 41G formed in the inverse-cam plate 41 relative to elevated seat-support platform 14 to cause pin support 14S to move along the radially extending cam-follower path toward vertical seat-rotation axis 16A to apply a movement-inducing force to bolt mover 20M so that movable bolt 20B is moved relative to rotatable seat 16 in response to movement of bolt mover 20M along the radially extending cam-follower path.

Pin-receiving groove 41G is curved to establish a diagonally extending arcuate pin-motion path as shown in FIGS. 5, 11, and 15. Pin 42P is arranged to lie in a radially inner section of pin-receiving groove 41G to lie a first distance from vertical seat-rotation axis 16A when bolt-mover actuator 20A is in the first actuator position associated with the seat-locking mode of seat-rotation blocker 20 as shown in FIG. 11. Pin 42P is arranged to lie in a radially outer section of pin-receiving groove 42G to lie at a relatively greater second distance from vertical seat-rotation axis 16A when bolt-mover actuator 20A is in the second actuator position associated with the seat-rotating mode of seat-rotation blocker 20 as shown in FIG. 15.

Motion-generator lever 30 includes a slide 31 that is mounted in an interior region formed in elevated seat-support platform 14 for sliding movement relative to elevated seat-support platform 14 between a first slide position shown in FIGS. 2A and 11 associated with the first actuator position of bolt-mover actuator 20A and a second slide position shown in FIGS. 3A and 15 associated with the second actuator position of bolt-mover actuator 20A. Cam 41 is coupled to slide 31 to move therewith as shown in FIGS. 5, 11, and 15.

Elevated seat-support platform 14 includes a top wall formed to include a tray and an outer rim 14OR arranged to depend from and surround a portion of the top wall as shown in FIG. 1. Outer rim 14OR is formed to include a lever-access window 30W as shown in FIGS. 2A, 3A, and 18 to expose an operator hand grip 320 included in slide 31 in each of the first and second slide positions of slide 31 to facilitate movement of slide 31 relative to elevated seat-support platform 14 between the first and second slide positions. Motion-generator lever 30 further includes slide-release means 32 illustrated in FIGS. 18-20 for releasably locking slide 31 in each of the first and second slide positions of slide 31 so that slide 31 is normally locked to elevated seat-support platform 14 when seat-rotation blocker 20 is in the seat-locking mode and in the seat-rotating mode until a push button 320 included in the slide-release means 32 is pushed inwardly by a user to release slide 31 for sliding movement relative to elevated seat-support platform 14.

The invention claimed is:

1. A juvenile walker comprising a rolling platform-elevation base adapted to roll on an underlying surface, a child carrier including an elevated seat-support platform mounted on the rolling platform-elevation base and a rotatable seat mounted for rotation on the elevated seat-support platform about a vertical seat-rotation axis, and a seat-rotation blocker including a movable bolt, a bolt-mover actuator, and a bolt mover coupled to the bolt-mover actuator and the movable bolt and supported for movement relative to the elevated seat-support platform, wherein the movable bolt is arranged to be moved relative to the elevated seat-support platform in a first direction to extend into a bolt-receiver slot formed in the rotatable seat to assume a seat-locking position engaged to the rotatable seat to block rotation of the rotatable seat relative to the elevated seat-support platform about the vertical seat-rotation axis to establish a seat-blocking mode of the seat-rotation blocker and in an opposite second direction to exit the bolt-receiver slot formed in the rotatable seat to assume a seat-rotating position disengaged from the rotatable seat to allow the rotatable seat to rotate relative to the elevated seat-support platform about the vertical seat-rotation axis to establish a seat-rotating mode of the seat-rotation blocker, and wherein the bolt mover is arranged to push the movable bolt automatically into the bolt-receiver slot formed in the rotatable seat when the rotatable seat is aligned in a predetermined position relative to the elevated seat-support platform and configured to withdraw the movable bolt from the bolt-receiver slot formed in the rotatable seat in response to movement of the bolt-mover actuator relative to the elevated seat-support platform about the vertical seat-rotation axis from a first actuator position associated with the seat-locking mode of the seat-rotation blocker to a second actuator position associated with the seat-rotating mode of the seat-rotation blocker.

2. The juvenile walker of claim 1, wherein the bolt mover includes a bolt pusher configured to provide means for yieldably urging the movable bolt into the bolt-receiver slot formed in the rotatable seat automatically upon rotation of the rotatable seat about the vertical seat-rotation axis to the predetermined position while the bolt-mover actuator remains in the first actuator position associated with the seat-locking mode of the seat-rotation blocker.

3. The juvenile walker of claim 2, wherein the elevated seat-support platform has a forward portion and an opposite rearward portion, the rotatable seat includes a seat back arranged to engage a back of a seated child seated in the rotatable seat during rotation of the rotatable seat about the vertical seat-rotation axis in sequence from a left-facing position first to a forward-facing position that is coextensive with the predetermined position to orient the seated child to face toward the forward portion of the elevated seat-support platform and then to a right-facing position, and the movable bolt is supported for movement on the elevated seat-support platform so that the movable bolt is able to extend into the bolt-receiver slot formed in the rotatable seat only when the rotatable seat is rotated about the vertical seat-rotation axis to assume the forward-facing position.

4. The juvenile walker of claim 3, wherein the child carrier further includes a push handle coupled to the opposite rearward portion of the elevated seat-support platform and configured to be gripped by an operator for use in pushing the rolling platform-elevation base to roll on the underlying surface.

5. The juvenile walker of claim 2, wherein the rotatable seat is mounted in an upwardly opening seat receiver formed in a central portion of the elevated seat-support platform to allow the rotatable seat to be rotated about the vertical seat-rotation axis when the seat-rotation blocker is placed in the seat-rotating mode in which the movable bolt is disengaged from the rotatable seat.

6. The juvenile walker of claim 5, wherein the rotatable seat includes a frame, several wheels mounted for rotation in a hollow space provided in the frame during rotation of the rotatable seat about the vertical seat-rotation axis, and several elastic retainer tabs cantilevered to the frame and configured to mate with and ride on a tab-engaging rim edge included in the elevated seat-support platform during rotation of the rotatable seat about the vertical seat-rotation axis.

7. The juvenile walker of claim 2, wherein the bolt-receiver slot of the rotatable seat is oriented to open radially outwardly away from the vertical seat-rotation axis during rotation of the rotatable seat about the vertical seat-rotation axis and the bolt pusher is configured to push a radially inwardly extending nose portion of the movable bolt toward the vertical seat-rotation axis and into the bolt-receiver slot automatically when the rotatable seat is rotated about the vertical seat-rotation axis to assume the predetermined position.

8. The juvenile walker of claim 7, wherein the elevated seat-support platform is formed to include a pair of bolt-guide members that are arranged to lie in spaced-apart parallel relation to the one another to guide the movable bolt along a radially extending path toward and away from the vertical seat-rotation axis during movement of the movable bolt into and out of the bolt-receiver slot formed in the rotatable seat.

9. The juvenile walker of claim 2, wherein the bolt pusher includes a spring arranged to interact between the movable bolt and the bolt-mover actuator to yieldably extend the movable bolt into the bolt-receiver slot formed in the rotatable seat automatically when the rotatable seat is rotated about the vertical seat-rotation axis to assume the predetermined position.

10. The juvenile walker of claim 9, wherein the spring is located in a hollow chamber formed in the movable bolt and includes an outer end engaged to an outer actuator wall of the bolt-mover actuator and an inner end engaged to an inner wall of the movable bolt providing a boundary of the hollow chamber.

11. The juvenile walker of claim 10, wherein the bolt pusher further includes a spring mount comprising an inner rod cantilevered to the inner wall of the movable bolt lie in the hollow chamber and to move with the movable bolt relative to the rotatable seat and an outer rod cantilevered to the outer wall of the bolt-mover actuator and arranged to engage the inner rod and wherein the spring is a coiled compression spring that is helically wound around the inner and outer rods of the spring mount.

12. The juvenile walker of claim 11, wherein the bolt-mover actuator includes a motion-generator lever that is arranged to be gripped by a caregiver and moved by the caregiver relative to the elevated seat-support platform in a first direction to establish the seat-locking mode of the seat-rotation blocker and in an opposite second direction to establish the seat-rotating mode of the seat-rotation blocker and the bolt-mover actuator further includes a motion-transfer system including a cam that is coupled to the motion-generator lever to move therewith and a cam follower that is formed to include the outer actuator wall that engages the outer end of the spring included in the bolt pusher of the bolt mover and engaged to the cam and coupled to the bolt mover to transfer motion from the motion-generator lever to the bolt mover for application to the movable bolt via the bolt mover.

13. The juvenile walker of claim 10, wherein the movable bolt further includes a side wall coupled to the inner wall to form a boundary of the hollow chamber and the bolt mover further includes a bolt retractor that is coupled to the outer actuator wall of the bolt-mover actuator and to the side wall of the movable bolt to retain the spring in a compressed state between and in engagement with the outer wall of the bolt-mover actuator and the inner wall of the bolt mover.

14. The juvenile walker of claim 13, wherein the side wall of the movable bolt is formed to a flange-receiving opening bounded by a first flange-attachment strip and the bolt retractor includes a first arm cantilevered to the outer actuator wall of the bolt-mover actuator and a first puller flange coupled to the first arm and arranged to extend into the flange-receiving opening formed in the side wall of the movable bolt and arranged to engage the first flange attachment strip to block movement of the inner wall of the movable bolt away from the outer actuator wall of the bolt-mover actuator under a yieldable spring load applied to the outer and inner walls by the spring.

15. The juvenile walker of claim 12, wherein the bolt-mover actuator includes a motion-generator lever that is arranged to be gripped by a caregiver and moved by the caregiver relative to the elevated seat-support platform in a first direction to establish the seat-locking mode of the seat-rotation blocker and in an opposite second direction to establish the seat-rotating mode of the seat-rotation blocker and the bolt-mover actuator further includes a motion-transfer system including a cam that is coupled to the motion-generator lever to move therewith and a cam follower that is formed to include the outer actuator wall that engages the bolt retractor of the bolt mover and engaged to the cam and coupled to the bolt mover to transfer motion from the motion-generator lever to the bolt mover for application to the movable bolt via the bolt mover.

16. The juvenile walker of claim 9, wherein the bolt mover further includes a bolt retractor configured to provide means for retracting a radially inwardly extending nose of the movable bolt that extends toward the vertical seat-rotation axis from the bolt-receiver slot formed in the rotatable seat to free the rotatable seat to rotate about the vertical seat-rotation axis while the bolt-mover actuator remains in the second actuator position associated with the seat-rotating mode of the seat-rotation blocker.

17. The juvenile walker of claim 16, wherein the movable bolt is formed to include a hollow chamber and a first flange-engagement strip bordering the hollow chamber and the bolt retractor includes a first arm cantilevered to an outer wall of the bolt-mover actuator and a first puller flange that is coupled to the first arm and arranged to engage the first flange-engagement strip to impart a radially outwardly directed retraction force to the movable bolt in response to movement of the bolt-actuator mover relative to the elevated seat-support platform from the first actuator position to the second actuator position.

18. The juvenile walker of claim 17, wherein the movable bolt is formed to include a second flange-attachment strip bordering the hollow chamber, the bolt retractor further includes a second arm cantilevered to the outer actuator wall of the bolt-mover actuator and a second puller flange that is coupled to the second arm and arranged to engage the second flange-engagement strip to impart another radially outwardly directed retraction force to the movable bolt in response to movement of the bolt-actuator mover relative to the elevated seat-support platform from the first actuator position to the second actuator position, and the spring of the bolt pusher is located in the hollow chamber formed in the movable bolt and arranged to lie midway between the first and second arms of the bolt retractor.

19. The juvenile walker of claim 1, wherein the bolt mover includes a bolt pusher that is arranged to push the movable bolt into the bolt-receiver slot formed in the rotatable seat when the rotatable seat has been rotated about the vertical seat-rotation axis to assume the predetermined position and a separate bolt retractor that is arranged to lie alongside the bolt pusher to retract the movable bolt from the bolt-receiver slot formed in the rotatable seat in response to movement of the bolt-mover actuator relative to the elevated seat-support platform to the second actuator position and wherein the bolt-mover actuator includes a motion-generator lever that is arranged to be gripped by a caregiver and moved by the caregiver relative to the elevated seat-support platform in a first direction to establish the seat-locking mode of the seat-rotation blocker and in an opposite second direction to establish the seat-rotating mode of the seat-rotation blocker and the bolt-mover actuator further includes a motion-transfer system that is arranged to interconnect the motion-generator lever to the movable bolt and configured to provide means for transferring motion from the motion-generator lever to the bolt mover to move the bolt mover in a radially inward direction relative to the elevated seat-support platform toward the vertical seat-rotation axis to cause the movable bolt to be extended into the bolt-receiver slot formed in the rotatable seat in response to sliding movement of the motion-generator lever in the first direction and to move the bolt mover in a radially outward direction relative to the elevated seat-support platform away from the vertical seat-rotation axis to cause the movable bolt to be retracted from the bolt-receiver slot formed in the rotatable seat in response to sliding movement of the motion-generator lever in the opposite second direction.

20. The juvenile walker of claim 19, wherein the motion-transfer system includes a cam that is coupled to the motion-generator lever to move therewith and a cam follower that is engaged to the cam and coupled to the bolt mover to transfer motion from the motion-generator lever to the bolt mover for application to the movable bolt via the bolt mover.

21. The juvenile walker of claim 20, wherein the cam comprises an inverse-cam plate formed to include a pin-receiving groove and the cam follower comprises a pin support coupled to the bolt mover and arranged to move back and forth along a radially extending cam-follower path intersecting the vertical seat-rotation axis during movement of the movable bolt into and out of the bolt-receiver slot formed in the rotatable seat and a pin coupled to the pin support and arranged to extend into the pin-receiving groove formed in the inverse-cam plate and wherein movement of the inverse-cam plate relative to the elevated seat-support platform in response to movement of the motion-generator lever relative to the elevated seat-support platform during movement of the bolt-mover actuator between the first and second actuator positions moves the pin in the pin-receiving groove formed in the inverse-cam plate relative to the elevated seat-support platform to cause the pin support to move along the radially extending cam-follower path toward the vertical seat-rotation axis to apply a movement-inducing force to the bolt mover so that the movable bolt is moved relative to the rotatable seat in response to movement of the bolt mover along the radially extending cam-follower path.

22. The juvenile walker of claim 21, wherein the pin-receiving groove is curved to establish a diagonally extending arcuate pin-motion path, the pin is arranged to lie in a radially inner section of the pin-receiving groove to lie a first distance from the vertical seat-rotation axis when the bolt-mover actuator is in the first actuator position associated with the seat-locking mode of the seat-rotation blocker, and the pin is arranged to lie in a radially outer section of the pin-receiving groove to lie at a relatively greater second distance from the vertical seat-rotation axis when the bolt-mover actuator is in the second actuator position associated with the seat-rotating mode of the seat-rotation blocker.

23. The juvenile walker of claim 20, wherein the motion-generator lever includes a slide that is mounted in an interior region formed in the elevated seat-support platform for sliding movement relative to the elevated seat-support platform between a first slide position associated with the first actuator position of the bolt-mover actuator and a second slide position associated with the second actuator position of the bolt-mover actuator and the cam is coupled to the slide to move therewith.

24. The juvenile walker of claim 23, wherein the elevated seat-support platform includes a top wall formed to include a tray and an outer rim arranged to depend from and surround a portion of the top wall and formed to include a lever-access window to expose an operator hand grip included in the slide in each of the first and second slide positions of the slide to facilitate movement of the slide relative to the elevated seat-support platform between the first and second slide positions.

25. The juvenile walker of claim 23, wherein the motion-generator lever further includes slide-release means for releasably locking the slide in each of the first and second slide positions of the slide so that the slide is normally locked to the elevated seat-support platform when the seat-rotation blocker is in the seat-locking mode and in the seat-rotating mode until a push button included in the slide-release means is pushed inwardly by a user to release the slide for sliding movement relative to the elevated seat-support platform.

26. The juvenile walker of claim 25, wherein the elevated seat-support platform includes a top wall formed to include a tray and an outer rim arranged to depend from and surround a portion of the top wall and formed to include a lever-access window opening into the interior region formed in the elevated seat-support platform to expose the push button included in the slide-release means.

27. A juvenile walker comprising a rolling platform-elevation base adapted to roll on an underlying surface, a child carrier including an elevated seat-support platform mounted on the rolling platform-elevation base and a rotatable seat mounted for rotation on the elevated seat-support platform about a vertical seat-rotation axis, and a seat-rotation blocker including a movable bolt, a bolt-mover actuator, and a bolt mover coupled to the bolt-mover actuator and the movable bolt and supported for movement relative to the elevated seat-support platform, wherein the movable bolt is arranged to be moved relative to the elevated seat-support platform in a first direction to extend into a bolt-receiver slot formed in the rotatable seat to assume a seat-locking position engaged to the rotatable seat to block rotation of the rotatable seat relative to the elevated seat-support platform about the vertical seat-rotation axis to establish a seat-blocking mode of the seat-rotation blocker in response to movement of a motion-generator lever included in the bolt-mover actuator relative to the seat-support platform in a different direction other than the first direction and in an opposite second direction to exit the bolt-receiver slot formed in the rotatable seat to assume a seat-rotating position disengaged from the rotatable seat to allow the rotatable seat to rotate relative to the elevated seat-support platform about the vertical seat-rotation axis to establish a seat-rotating mode of the seat-rotation blocker in response to movement of the motion-generator lever relative to the seat-support platform in yet another direction.

* * * * *